US010677552B2

(12) United States Patent
Wilkinson et al.

(10) Patent No.: US 10,677,552 B2
(45) Date of Patent: Jun. 9, 2020

(54) MODULAR MAGAZINE WELL INSERT SYSTEM FOR FIREARM

(71) Applicant: Sturm, Ruger & Company, Inc., Southport, CT (US)

(72) Inventors: Todd Wilkinson, Goshen, NH (US); Frank J. Saunders, Weare, NH (US)

(73) Assignee: STURN, RUGER & COMPANY, INC., Southport, CT (US)

( * ) Notice: Subject to any disclaimer, the term of this patent is extended or adjusted under 35 U.S.C. 154(b) by 0 days.

(21) Appl. No.: 16/241,536

(22) Filed: Jan. 7, 2019

(65) Prior Publication Data

US 2019/0212085 A1 Jul. 11, 2019

Related U.S. Application Data

(60) Provisional application No. 62/615,256, filed on Jan. 9, 2018.

(51) Int. Cl.

| | |
|---|---|
| ***F41A 11/02*** | (2006.01) |
| ***F41A 9/65*** | (2006.01) |
| ***F41A 17/38*** | (2006.01) |
| ***F41A 3/66*** | (2006.01) |

(52) U.S. Cl.

CPC ..... *F41A 11/02* (2013.01); *F41A 3/66* (2013.01); *F41A 9/65* (2013.01); *F41A 17/38* (2013.01)

(58) Field of Classification Search

CPC .... F41A 3/66; F41A 9/65; F41A 11/02; F41A 17/38

USPC ..... 42/49.01, 49.02, 49.1, 50

See application file for complete search history.

(56) References Cited

U.S. PATENT DOCUMENTS

| | | | | |
|---|---|---|---|---|
| 553,291 | A | 1/1896 | Nicholsburg | |
| 2,997,803 | A * | 8/1961 | Florence | F41A 9/70 42/18 |
| 3,362,095 | A | 1/1968 | Jacob | |
| 5,416,998 | A | 5/1995 | Martel | |
| 6,070,352 | A | 6/2000 | Daigle | |
| 7,444,775 | B1 | 11/2008 | Schuetz | |
| 7,823,312 | B2 | 11/2010 | Faifer | |
| 7,941,955 | B2 | 5/2011 | Stone | |

(Continued)

FOREIGN PATENT DOCUMENTS

| | | |
|---|---|---|
| EP | 3124910 | 2/2017 |
| WO | 201317907 | 2/2013 |

OTHER PUBLICATIONS

International Search Report and Written Opinion from PCT/US2019/12529, dated Apr. 1, 2019, pp. 1-11.

*Primary Examiner* — Bret Hayes
(74) *Attorney, Agent, or Firm* — The Belles Group, P.C.

(57) ABSTRACT

A modular magazine well insert system accepts and latches different types of magazines including front and side catch styles. The system includes a plurality of magazine well inserts each having a common mounting interface which interfaces with a mounting feature formed in a receptacle of the firearm stock. The inserts may have a common basic configuration with some different features adapted for use with different magazine catch features, such as latching levers for front catch magazines or lateral apertures to access side catch magazines. A universal latch stud slideably mounted in the stock comprises features which cooperate with each of the magazine well inserts to retain and release both catch styles of magazines in the insert.

29 Claims, 36 Drawing Sheets

(56) References Cited

U.S. PATENT DOCUMENTS

| | | | | |
|---|---|---|---|---|
| 8,127,480 | B1 | 3/2012 | McManus et al. | |
| 8,387,296 | B2 | 3/2013 | Overstreet et al. | |
| 8,397,415 | B2 | 3/2013 | Laney et al. | |
| 8,464,453 | B1 | 6/2013 | Ubi et al. | |
| 8,479,635 | B2 | 7/2013 | Overstreet et al. | |
| 8,590,203 | B1 | 11/2013 | McCarthy et al. | |
| 8,726,554 | B2 | 5/2014 | Klassen | |
| 8,832,987 | B2 | 9/2014 | Addis | |
| 8,898,946 | B1 | 12/2014 | Johnson | |
| 9,010,004 | B1 | 4/2015 | Fu | |
| 9,194,637 | B2 | 11/2015 | Mather | |
| 9,372,043 | B2 | 6/2016 | Larson, Jr. et al. | |
| 2006/0026883 | A1* | 2/2006 | Hochstrate | F41C 23/16 42/75.01 |
| 2012/0180360 | A1 | 7/2012 | Jones | |
| 2012/0304420 | A1 | 12/2012 | Huberts | |
| 2012/0304520 | A1* | 12/2012 | Battaglia | F41A 3/64 42/75.03 |
| 2013/0180143 | A1 | 7/2013 | Acarreta | |
| 2013/0269231 | A1 | 10/2013 | Pietrzyk | |
| 2014/0325886 | A1 | 11/2014 | Mather | |
| 2017/0030667 | A1 | 2/2017 | Eitan et al. | |
| 2017/0082385 | A1 | 3/2017 | Orne, III | |
| 2017/0138685 | A1* | 5/2017 | Beasley | F41A 9/71 |
| 2017/0146308 | A1 | 5/2017 | Plumb | |
| 2017/0227312 | A1 | 10/2017 | Christensen | |
| 2018/0031343 | A1* | 2/2018 | Caudle | F41A 11/02 |

* cited by examiner

MODULAR MAGAZINE WELL INSERT SYSTEM FOR FIREARM

CROSS-REFERENCE TO RELATED APPLICATIONS

The present application claims the benefit of U.S. Provisional Application No. 62/615,256 filed Jan. 9, 2018; the entirety of which is incorporated herein by reference.

BACKGROUND

The present invention generally relates to firearms, and more particularly to a modular magazine well insert system which accepts and latches different types of magazines.

Many different firearms have been produced which shoot popular ammunition cartridges or rounds. Some firearms utilize a removable ammunition magazine which stores and dispenses a plurality of spring-biased cartridges, each of which is uploaded into the action of the firearm each time the action is cycled. The latching mechanism of the firearm which retains the magazine is generally designed to retain a magazine having a specific type or style of magazine retention feature also referred to as a "catch." Presently, there is no industry standardization for magazine catches. Accordingly, magazine manufacturers may provide magazines with retention catches that may be variously disposed on the magazine's side, front, rear, or combinations thereof even for the same caliber of ammunition. The catches typically comprise a protruding retention lip or opening in the tubular magazine casing which is positioned to engage the firearm's magazine latching mechanism. Even for magazines using a single type of catch (e.g. rear, front, or side), the catch may be physically located at different heights or elevations by various manufacturers. This typically makes the latching mechanism of the firearm incompatible for use with several different magazines, thereby limiting the firearm for use with a single magazine.

The foregoing situation imposes limitations on both firearm manufacturers and end users by limiting the interchangeability of different magazines with a single firearm model. An improved magazine latching mechanism is desired which can accommodate several different magazine latch systems.

SUMMARY OF THE INVENTION

A modular and interchangeable magazine well insert system described herein allows firearms to accept magazines having different types of retention or catch features while conveniently providing actuation by a single-motion universal actuation member that operates a variety of different magazine retention or catch features provided with the magazine well inserts. The system generally includes a firearm frame or stock defining a common interface and a plurality of removable and interchangeable magazine well inserts each having a unique retention feature especially configured for retaining a specific type magazine with a distinctive catch style. In one non-limiting example, the retention feature of a first magazine well insert may be a lateral opening or window in the magazine well that functions in cooperation with the universal actuation member on a side catch style magazine having a corresponding side retention or catch feature (e.g. opening, window, etc.). In another non-limiting example, the retention feature of a second magazine well insert may be a latch mechanism with pivotably movable latch lever that functions with a magazine having a first type front retention/catch feature (e.g. protruding lip, opening, etc.). In another non-limiting example, the retention feature of a third magazine well insert may be a latch mechanism with pivotably movable latch lever that functions with a magazine having a second type front retention/catch feature (e.g. protruding lip, opening, etc.) different than the first type front retention/catch feature.

A single universal actuation member is provided configured to advantageously functions with both side-latching magazines and at least one front latching type magazine. This means that the firearm magazine release function for the user will operate the same way with one type of user action on the actuation member no matter which of the interchangeable magazine well inserts and side or front latching magazine are used, thereby providing an integrated latching system for retaining and releasing magazines from a firearm having multiple different style retention or catch features. In one implementation, the foregoing magazine well inserts may each be configured to hold magazines designed for a single caliber (e.g. 9 mm or other), but which utilize three different catch styles.

The universal actuation member may be a spring-biased laterally moveable latch stud, which in one non-limiting embodiment is slideably mounted in the receiver or stock of the firearm. The latch stud thus remains mounted in the firearm when different magazine well inserts and magazines are interchanged. The latch stud is configured to actuate latch mechanisms mounted in the interchangeable magazine well insert for retaining magazines having a front retention feature. In one configuration, the latch stud is configured to actuate two different types of front latching magazine latch levers as described above. Embodiments of the same latch stud may further be configured to include a side latch protrusion operable to engage the lateral opening or window of a side latching magazine. In one implementation, the universal latch stud may be transversely oriented and slideably disposed in the stock immediately forward of an open receptacle in the stock configured accept each of the different magazine well inserts. Pushing the latch stud in a lateral direction relative to the longitudinal axis of the firearm advantageously actuates and releases all of the foregoing different catch style magazines. The stock may be configured to mount the latch stud in an ambidextrous manner for operation by right or left handed users depending on the particular catch style of magazine being used with the magazine well insert system.

In one aspect, a modular magazine well insert system for a firearm comprises: a longitudinal axis; a stock defining an open mounting receptacle; an elongated magazine latch stud transversely disposed in the stock proximate to the receptacle, the latch stud slideably movable in a lateral direction between a locked position and an unlocked position; a first magazine well insert configured for insertion and detachable mounting in the receptacle, the first magazine well insert comprising a walled body defining a downwardly open central cavity configured for receiving a first magazine therein having a front catch feature, and a pivotable first latch lever movable to selectively retain or release the first magazine when positioned in the central cavity; and a second magazine well insert configured for insertion and detachable mounting in the receptacle, the second magazine well insert comprising a walled body defining a downwardly open central cavity configured for receiving a second magazine therein having a side catch feature; wherein the first and second magazine well inserts each have a common first mounting interface configured to mate with a corresponding second mounting interface formed in the receptacle of the stock.

In another aspect, a modular magazine well insert system for a firearm comprises: a longitudinal axis; a stock extending along the longitudinal axis and including a right sidewall, a left sidewall, and an upwardly open stock receptacle configured for mounting one of a plurality of interchangeable magazine well inserts therein each configured and operable to retain an ammunition magazine; each of the plurality of magazine well inserts have a common mounting interface configured to mate with a corresponding upward facing mounting interface formed on the stock within the stock receptacle and a downward facing mounting interface formed on a bottom of a receiver attached to the stock; an elongated magazine latch stud extending transversely through the right and left sidewalls of the stock proximate to the receptacle, the latch stud defining a centerline transversely oriented to the longitudinal axis, the latch stud slideably movable in a lateral direction between an inward locked position and an outward unlocked position; a spring biasing the latch stud towards the locked position; the latch stud including an operating end configured for actuating the latch stud and a latching end configured for engaging a side catch feature of a side latching magazine, and a rearwardly open recess between the ends defining a cam surface obliquely angled to the centerline of the latch stud for operating a latching lever of a magazine well insert configured to engage a front catch feature of a front latching magazine.

In another aspect, a method for retaining magazines in a firearm comprises: providing a firearm stock having a laterally movable latch stud slideably mounted therein; inserting a first magazine well insert into an open receptacle of the firearm stock adjacent to the latch stud; engaging a pair of peripheral mounting flanges on the first magazine well insert with a corresponding pair of seating surfaces disposed in the receptacle of the firearm stock; lowering a receiver onto the firearm stock; engaging a pair of locking surfaces on the receiver with the pair of mounting flanges on the first magazine well insert; drawing the receiver downwards in the firearm stock via tightening at least one mounting fastener; compressing the mounting flange of the first magazine well insert between the locking surfaces and seating surfaces; and inserting a first magazine into the first magazine well insert.

BRIEF DESCRIPTION OF THE DRAWINGS

The features of the exemplary embodiments will be described with reference to the following drawings where like elements are labeled similarly, and in which:

All drawings are schematic and not necessarily to scale. Parts shown and/or given a reference numerical designation in one figure may be considered to be the same parts where they appear in other figures without a numerical designation for brevity unless specifically labeled with a different part number and described herein. Any references herein to a whole figure number (e.g. FIG. 1) shall be construed to be a general reference to all subpart figures in the group (e.g. FIGS. 1A, 1B, etc.) unless otherwise indicated.

DETAILED DESCRIPTION OF EMBODIMENTS

Figure 1:
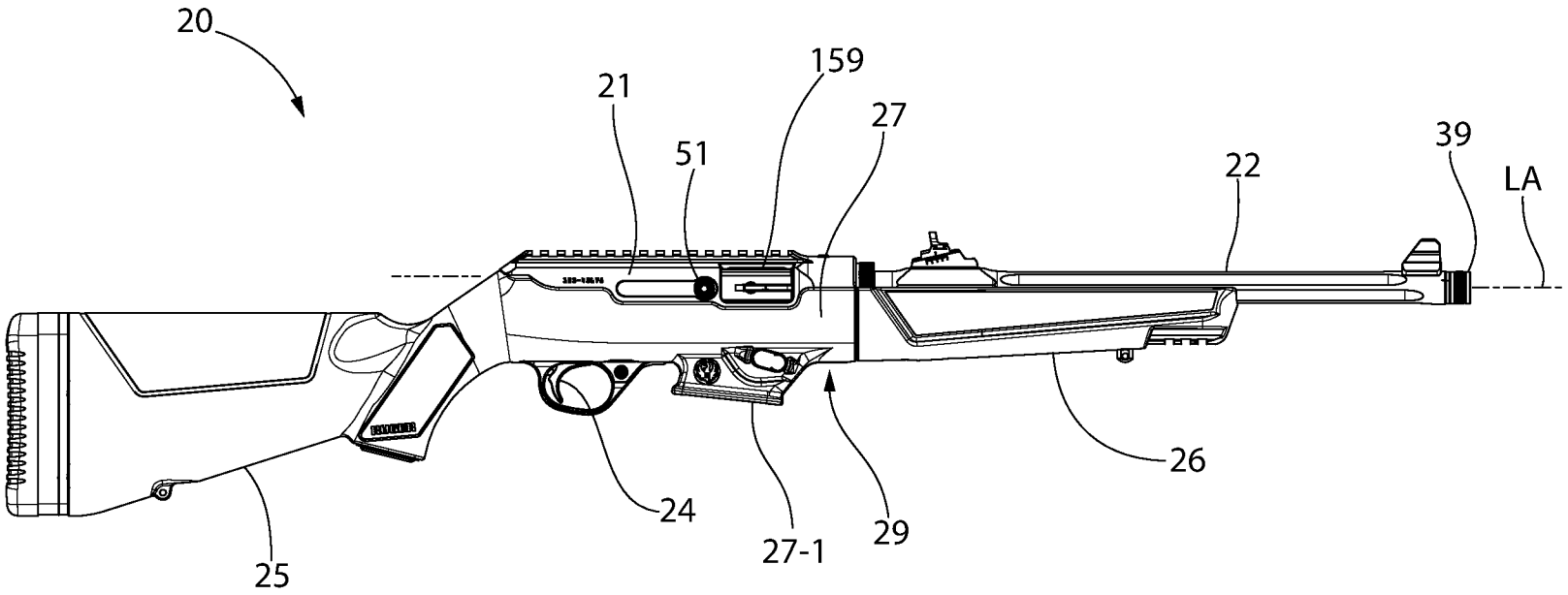
FIGS. 1 and 2 are right and left side views respectively of a firearm with a modular magazine well insert system according to the present disclosure.
Figure 2:
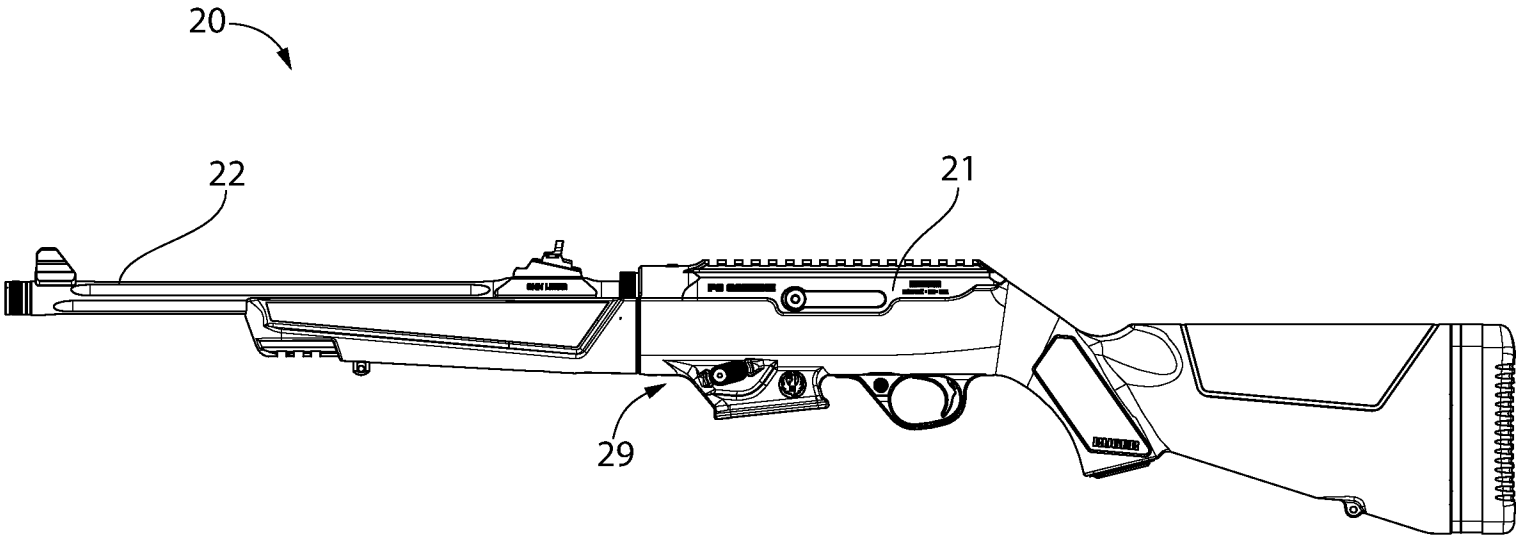
Figure 3:
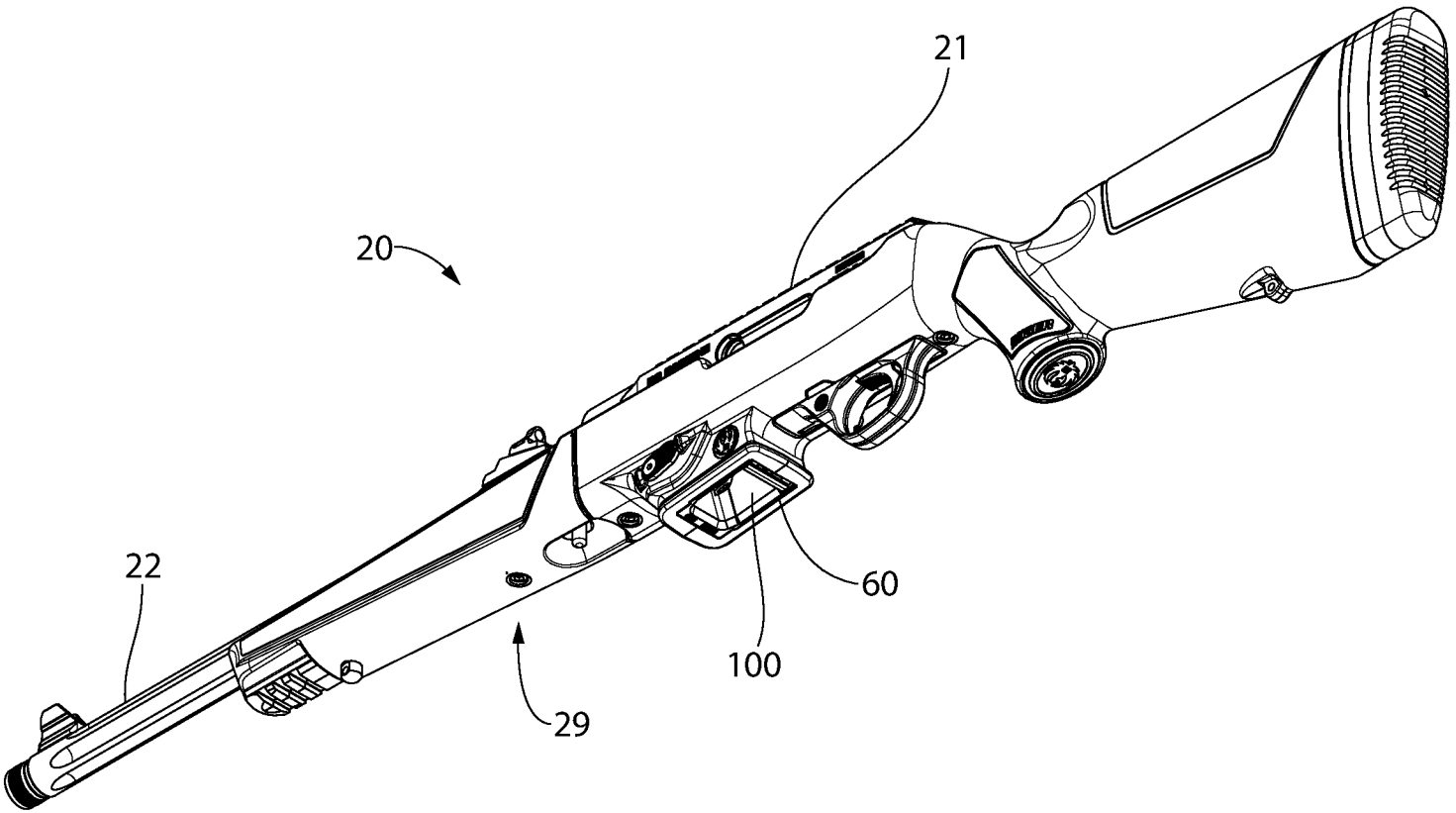
FIGS. 3 and 4 are left and right bottom perspective views respectively thereof.
Figure 4:
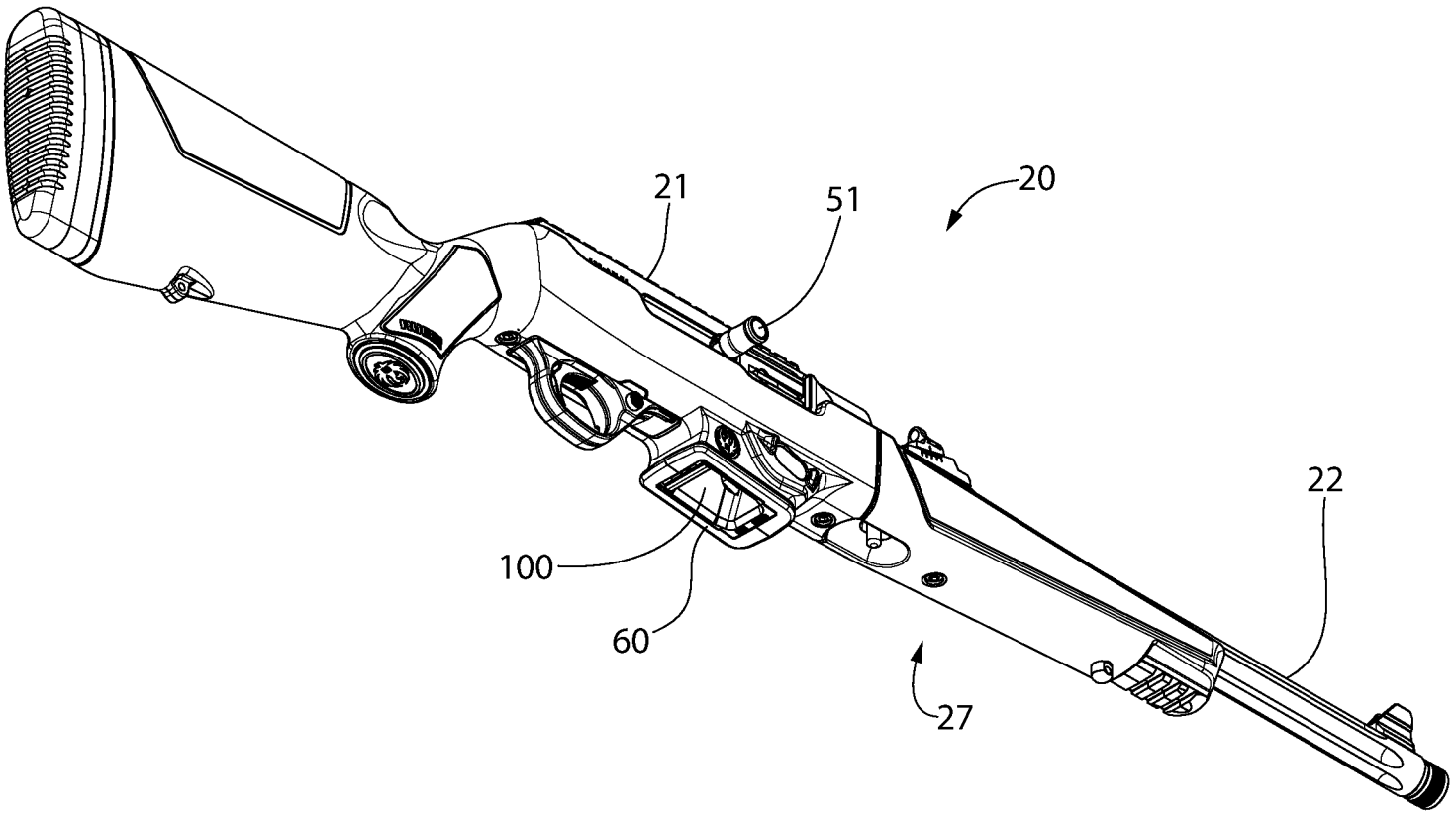

The features and benefits of the invention are illustrated and described herein by reference to preferred but non-limiting exemplary embodiments. This description of the embodiments is intended to be read in connection with the accompanying drawings, which are to be considered part of the entire written description. Accordingly, the invention expressly should not be limited to such embodiments illustrating some possible non-limiting combination of features that may exist alone or in other combinations of features; the scope of the invention being defined by the claims appended hereto.

In the description of embodiments disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures may be secured or attached to one another either directly or indirectly through intervening structures, as well as both movable or rigid attachments or relationships, unless expressly described otherwise.

FIGS. 1-6 depict a firearm 20 including a modular and interchangeable magazine well insert system according to the present disclosure. In one non-limiting embodiment, the firearm as illustrated may be a carbine. However, the firearm could be a rifle with longer barrel or a shotgun either of which operates via a box-style magazine, as further described herein. Accordingly, the invention is not limited in its applicability to any particular type firearm and should be broadly construed.

Firearm 20 includes a longitudinal axis LA, receiver 21, barrel 22 coupled thereto, bolt assembly 50, a chassis or frame such as stock 29, and a trigger-actuated firing mechanism 23 supported by the stock and/or receiver and including a movable trigger 24 for discharging the firearm. The firearm stock 29 comprises a rear buttstock 25, a mid-stock 27, and a front forearm 26. The mid-stock 27 defines an upwardly open longitudinal chamber 28 configured for receiving and mounting the receiver and firing mechanism therein (see also FIG. 36). In one embodiment, the stock may be molded as a monolithic unitary structure formed of reinforced polymer, which is configured to define the buttstock, mid-stock, and forearm. Other materials however may be used for stock 29 including wood and composites. The material selection is not limiting of the invention.

Barrel 22 includes an axial bore 30 extending longitudinally and axially from a rear breech end 38 attached to the receiver 21 to a front muzzle end 39 from which a bullet or slug is discharged from the firearm. Bore 30 defines a pathway for the bullet or slug. The centerline of bore 30 is coaxial with and defines the longitudinal axis LA of the firearm. The rear breech end 38 of the barrel 22 defines a rearwardly open diametrically enlarged chamber 36 which is configured for holding a single cartridge C for firing.

Receiver 21 defines an axially elongated internal cavity 40 which slideably carries and supports the bolt assembly 23. Cavity 32 extends along the longitudinal axis LA between an open front end in communication with the barrel chamber for loading cartridges therein and a rear end. Barrel 22 is coupled to the front end of the receiver so that the barrel axial bore 30 and rear chamber 36 is in communication with the receiver cavity 40 for chambering cartridges when the action is cycled. In one embodiment, receiver 21 may further comprise a forward barrel block sub-assembly 33 (or simply "barrel block") at a front end thereof that is configured to mount and support the barrel 22. Barrel 22 may be coupled to the sub-assembly 33 by any suitable means known in the art, including for example without limitation a threaded connection, press or friction fit, threaded lock or barrel nut compression joint, quick disconnect rotary lock feature, or other methods. The means of attachment is not limiting of the invention.

Bolt assembly 50 includes a forward bolt head 34 which defines a vertical front breech face which abuttingly engages and supports the end of the cartridge casing for firing when resident in chamber 38. Bolt assembly 50 is axially movable in the internal cavity 40 of the receiver 21 between forward closed breech and rearward open breech positions. A bolt handle 51 is rigidly secured to the bolt 52 of the assembly to manually cycle the action and move the bolt between the forward and rearward positions. Bolt assembly 50 is also automatically moved under recoil between the forward and rearward positions when the action is cycled after discharging the firearm to eject a spent cartridge casing and chamber a new fresh cartridge. Cavity 40 therefore has an axial length to provide the full range of motion necessary for the bolt assembly 50 moving rearward under recoil to open the breech sufficiently for extracting and ejecting a spent cartridge casing, and uploading a new cartridge into the barrel chamber 36 from the magazine, which may be any one of several different magazines as further described herein. In one embodiment, without limitation, the bolt 52 may be part of a "blowback" type action firearm in which the bolt does not lock in place with the barrel chamber by using a rotating bolt or other type of mechanical toggle. Simple blow back designs are generally feasible for cartridges with low pressures, typically for example .22LR, 9 mm, .45ACP, and .40 S&W. The main resistance which keeps the breach closed is achieved through the slide mass and recoil spring.

The firing mechanism 23 may further include the following components: a pivotable and cockable hammer 25; pivotable sear 26 which is configured and operable to hold the hammer in a rear cocked position (see, e.g. FIG. 5); a pivotably sear disconnector 27 operably engaged with the sear; and disconnector spring 27*a* acting between the disconnector and sear. Hammer 25 is biased forward by hammer spring 31. Pulling the trigger 24 rearward operates to lift disconnector 27 which in turn rotates the sear 26. This disengages a hook or ledge 28 formed on the front of the sear from a downward facing sear notch 29 on the hammer 25, thereby releasing spring-biased hammer 25 forward which strikes the rear end of firing pin 30 slideably carried by the bolt assembly 50. This drives the firing pin forward to strike a chambered cartridge C held in the chamber 36 of the barrel 22 for discharging the firearm 20. The bolt assembly 50 is thrust rearward under recoil which opens the breech for extracting and ejecting the spent cartridge casing. Recoil spring 42 returns the bolt assembly 50 forward while a fresh cartridge is uploaded from the magazine into the breech and chambered as the bolt assembly travels forward to the closed breech position.

Figure 5:
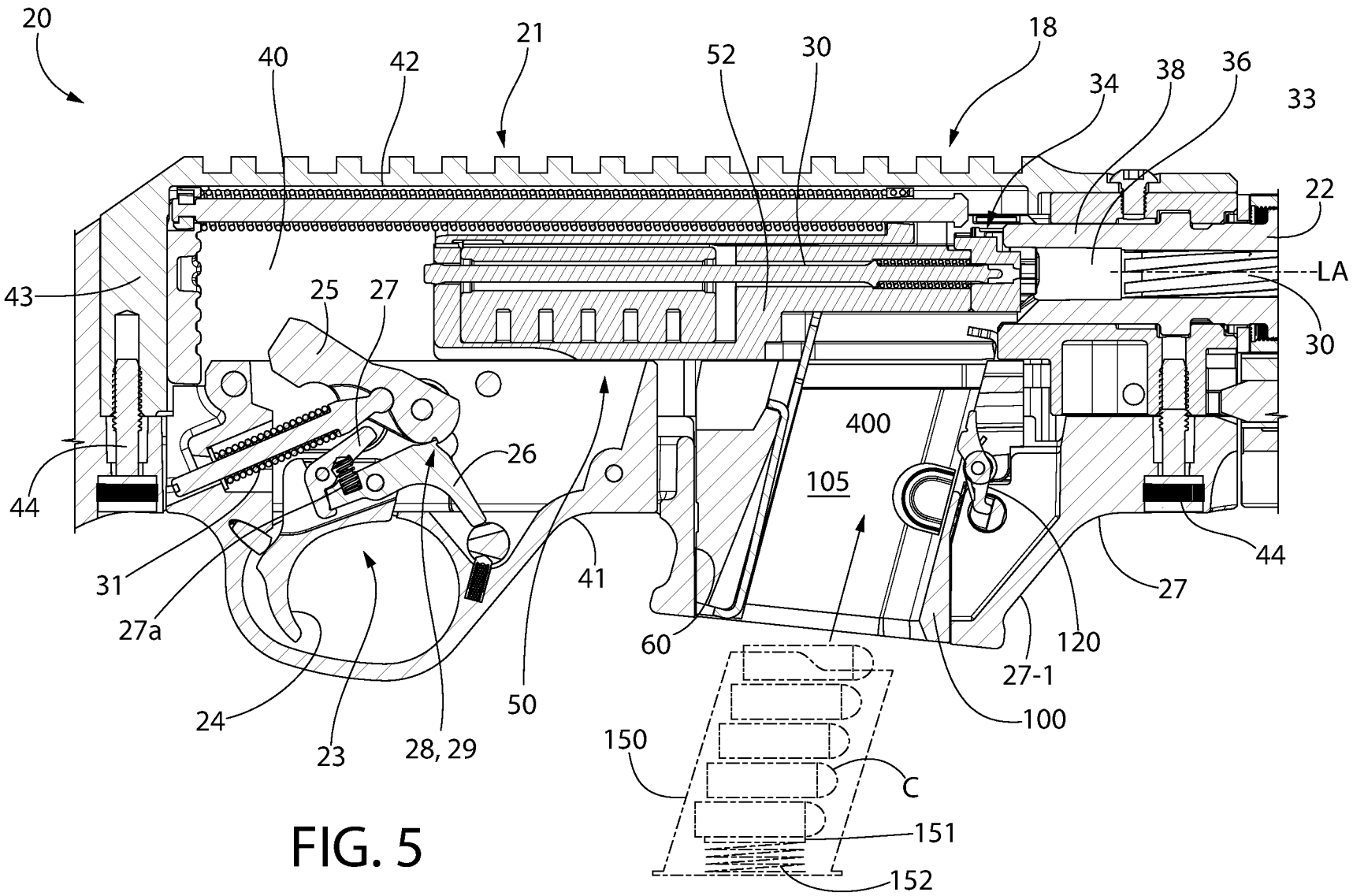
FIG. 5 is a right side cross-sectional view of the action portion of the firearm showing the firing mechanism component and one embodiment of a magazine well insert positioned in the stock of the firearm.

The foregoing firing mechanism components are movably disposed in the receiver 21 and/or mid-stock 27 of firearm 20. In one embodiment, these components may be pre-mounted in a separate and removable trigger or firing control housing 41 for ease of assembly. The firing control housing 41 is subsequently in turn mounted in the mid-stock 27 of the firearm beneath the receiver 21. The receiver 21 may be secured to the mid-stock 27 in an upwardly open and longitudinally-extending upper cavity 510 formed between sidewalls 411 via a single or multiple threaded fasteners 44 as best shown in FIG. 5. The longitudinal cavity 510 is in communication with magazine well insert mounting receptacle 60, which is upwardly and downwardly open. In one non-limiting arrangement, one fastener 44 may secure the rear 43 of the receiver to the mid-stock 27 and another fastener 44 secures the barrel block sub-assembly 33 to the mid-stock. Other arrangements or types of mounting methods may be used to secure the receiver to the stock.

The mid-stock 27 defines an vertical upwardly and downwardly open receptacle 60 configured to interchangeably accept and retain any one of the different magazine well inserts 100, 200, 300 disclosed herein. The inserts in turn are each specifically configured for selectively mounting and retaining a different removable ammunition magazine with different catch/retention features as further described herein. The mid-stock 27 may include an annular extension sleeve 27-1 which protrudes downwardly from the upper portion of the mid-stock and which defines at least a portion of the receptacle 60. This at least partially conceals the magazine well insert when positioned in the mid-stock. In some embodiments as illustrated in FIGS. 1-5, the magazine well insert 100, 200, or 300 may not protrude below the mid-stock extension sleeve 27-1.

It bears noting the magazine well insert receptacle 60 has dimensions and a plain configuration which is incapable of retaining a magazine therein without the presence of a magazine well insert. There are no magazine latching levers or other such retention features incorporated within the receptacle 60 of the mid-stock 27 which can operate to retain a magazine alone in the stock without use of the magazine well inserts disclosed herein. Instead, the receptacle 60 is configured and functions to provide a common mounting interface which can accept any of the present magazine well inserts of the modular system. The interchangeable magazine well inserts include the necessary magazine retention features such as latching levers for front catch style magazines, or access ports or apertures for side catch style magazines as further described herein.

One example of a box type ammunition magazine 150 is shown in FIG. 5 (in dashed lines) positioned for insertion into a magazine well insert 100 mounted to the mid-stock 27 detachably mounted in the well. Such box-type magazines may hold a spring-biased vertical stack of ammunition cartridges C which are uploaded into the breech area of the receiver 21 for loading into the rear chamber 36 of barrel 22 by the bolt assembly 50 in a conventional manner when cycling the action. In one embodiment, the cartridge C may be a centerfire cartridge with a centrally located percussion cap disposed in the rear exposed end of the base of the cartridge. This type of cartridge is well known to those skilled in the art without further elaboration. In other possible embodiments, the cartridge may be a rimfire cartridge also well known in the art.

FIGS. 1-6 show one of the plurality of different interchangeable magazine well inserts disclosed herein mounted in the mid-stock 27 of the firearm 20. The modular magazine well insert system will now be described in greater detail.

FIGS. 7-29 depict three non-limiting examples of magazine well inserts 100, 200, and 300 useable in the modular magazine well insert system of firearm 20. Each magazine well insert has generally the same overall configuration and outer dimensions, and share a majority of common features. Differences therefore generally lie in the magazine retention features or mechanisms for retaining magazines having different types of catch or retention features (e.g. front or side latching style magazines). For convenience, magazine well inset 100 shown in FIGS. 1-14 will first be described as the base example bearing the foregoing points in mind, and recognizing that the general description is applicable to each of the inserts 100, 200, and 300. Differences in the inserts and latching mechanisms will be noted as applicable and fully described below.

Referring generally first to FIGS. 1-14, magazine well insert 100 is a partially open and four sided in structure of sufficient height to effectively and securely retain a magazine therein in a stable manner. Magazine well insert 30 comprises a walled body including a front wall 101, opposing rear wall 102, and transversely spaced apart right and left lateral sidewalls 103, 104 extending between the front and rear walls. The walls collectively define an open central cavity 105 extending vertically between and through a top 106 and bottom 107 of the magazine well insert 100 for slideably inserting a first magazine 150 at least partially therein when mounted to the firearm. This defines a top opening 108 and bottom opening 109. Walls 101-104 and central cavity 105 may have a rectilinear or rectangular configuration in transverse cross section providing a complementary configuration to the rectangular cross-sectional shape of "box style" magazine 150 which is well known in the art without undue elaboration. Such magazines 150 may contain a straight or laterally staggered vertical stack of ammunition cartridges C, which are uploaded into the breech area in the receiver 21 by a magazine spring 152 biased follower 151 for chambering into the rear of barrel 22 by the bolt assembly 23 in a conventional manner when cycling the action (see also FIG. 5). When magazine 150 is seated in the magazine well insert 100, the upper portion of the magazine may protrude beyond top opening 108 and lower portion of the magazine may protrude downwards below bottom opening 109.

Magazine well inserts 100, 200, and 300 each includes a commonly configured mounting feature arranged to operably mate with complementary configured mounting features of the mid-stock 27 and receiver 21, thereby collectively forming a common mounting interface. Referring to FIGS. 7-10 showing magazine well insert 100 for example, each magazine well insert includes a pair of peripheral mounting flanges 110 extending parallel to longitudinal axis LA and protruding laterally/transversely outwards from sidewalls 103, 104 of the insert in opposite directions. Each mounting flange 110 includes a downward facing bottom bearing surface 111 and opposing upward facing top bearing surface 112. In one non-limiting embodiment, the mounting flanges 110 may be formed on a dimensionally enlarged upper mounting portion 113 of the magazine well insert 100 that may project longitudinally beyond the front and/or rear walls 101, 102 of the insert. The mounting rails 110 in turn may similarly extend beyond the front and rear walls having an axial length which is substantially coextensive with the length of the upper portion 113. The lower portion 113-1 of magazine well insert 100 below mounting flanges 110 may be taller than the upper portion 113 and laterally narrower in width than the flanges for reasons which will become apparent when mounting the magazine well insert in the stock receptacle 60, as further described herein.

Figure 36:
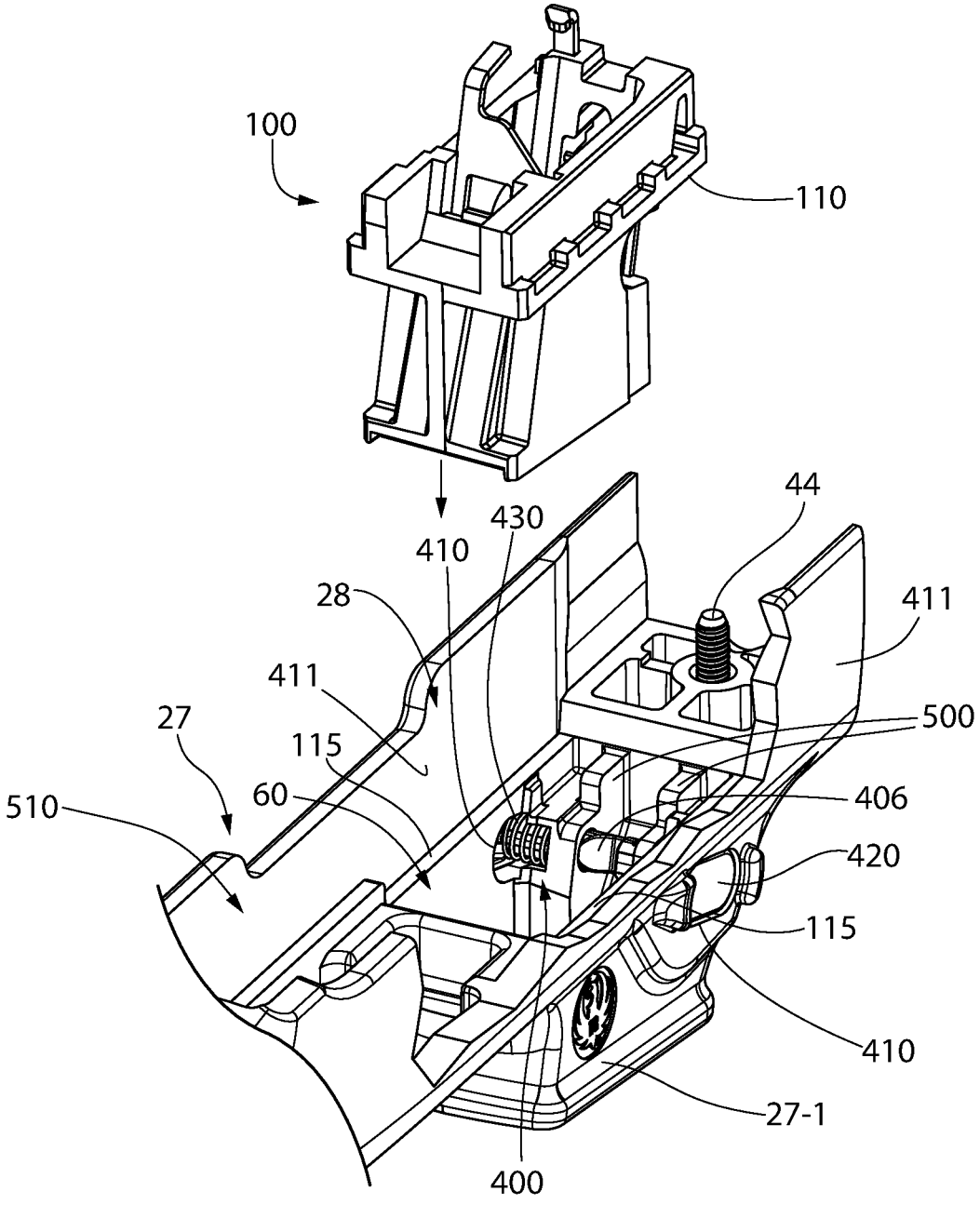
FIG. 36 is an exploded perspective view showing the first magazine well insert positioned for insertion into a receptacle formed in the mid-stock of the firearm.
Figure 37:
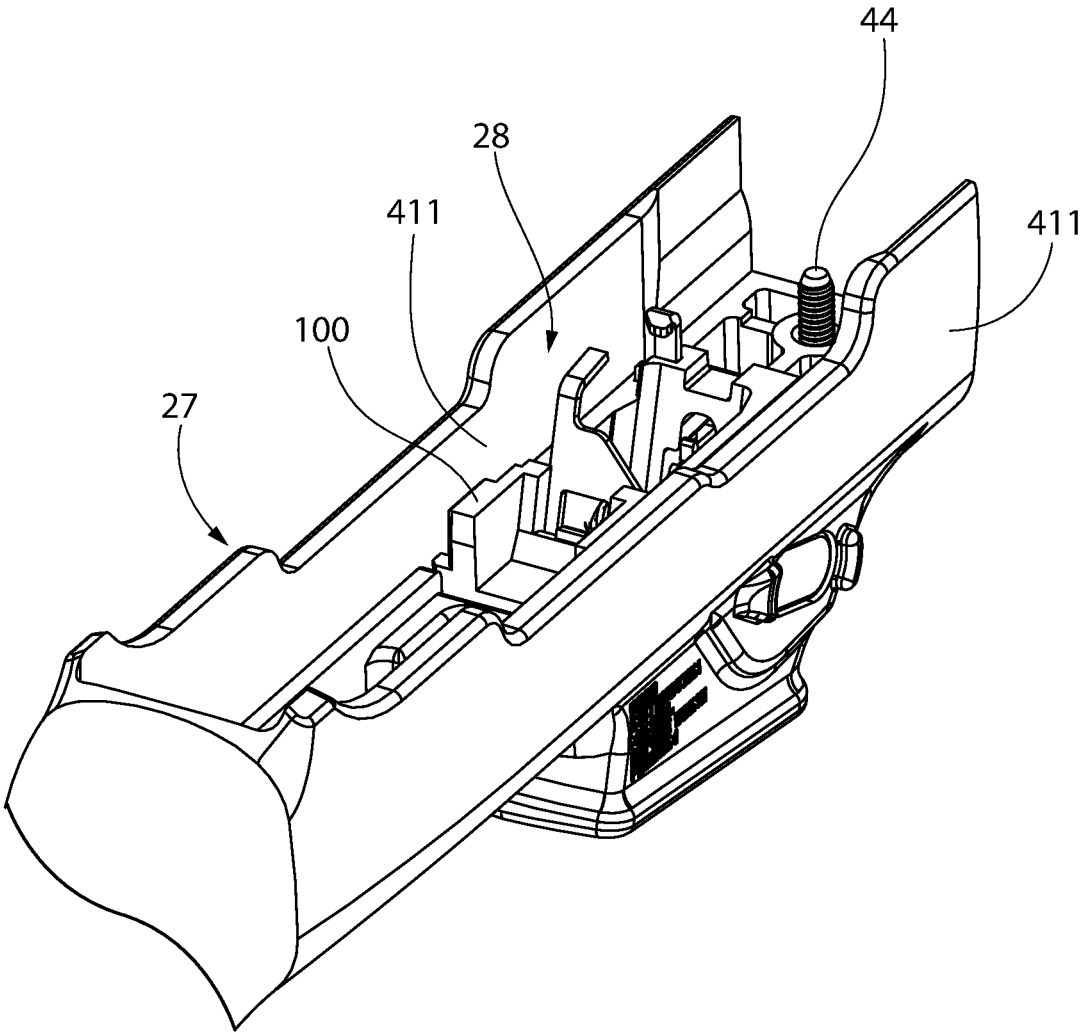
FIG. 37 is a second perspective view showing the first magazine well insert now mounted in mid-stock.
Figure 38:
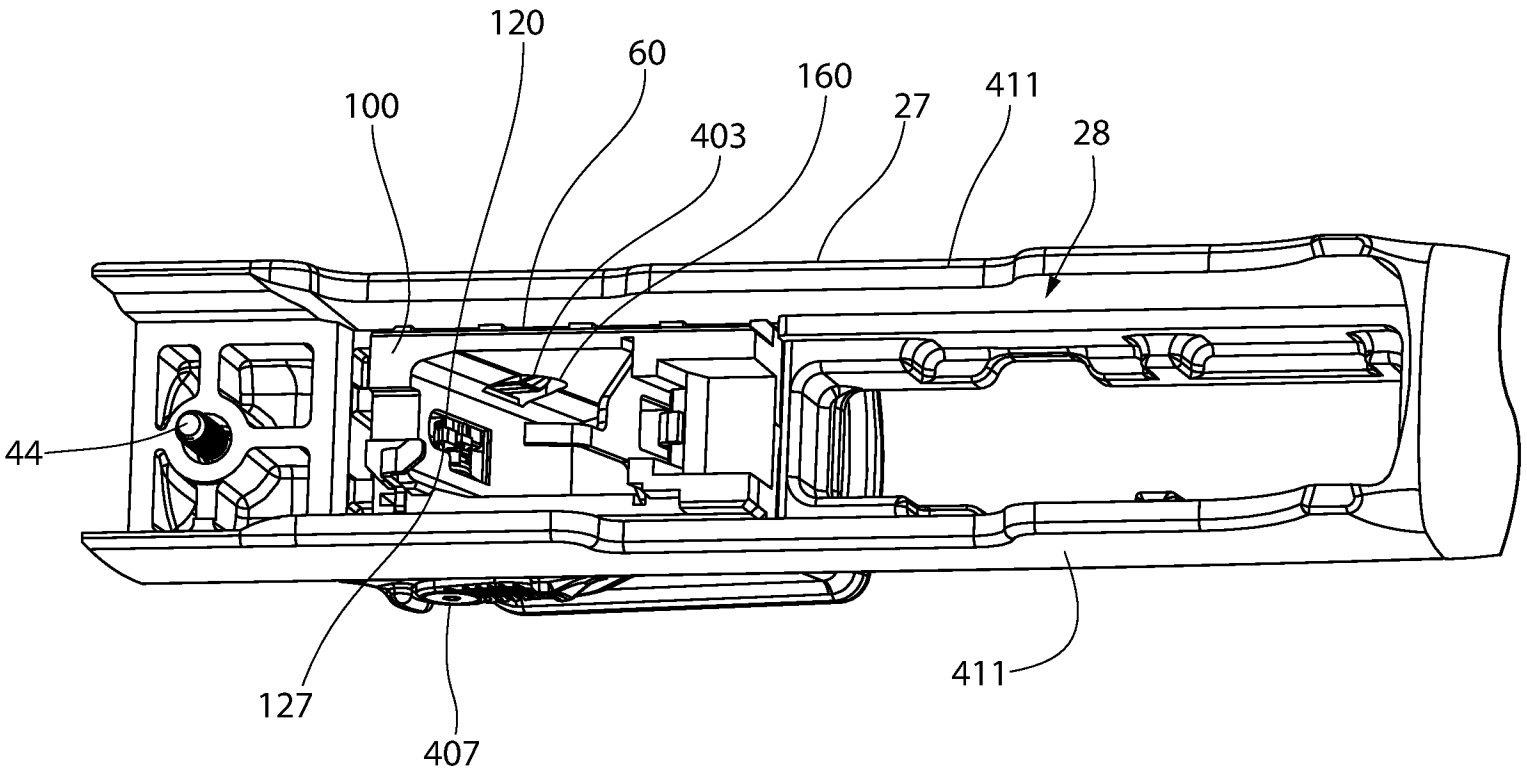
FIG. 38 is a top perspective view showing the first magazine well insert mounted in the firearm mid-stock.
Figure 39:
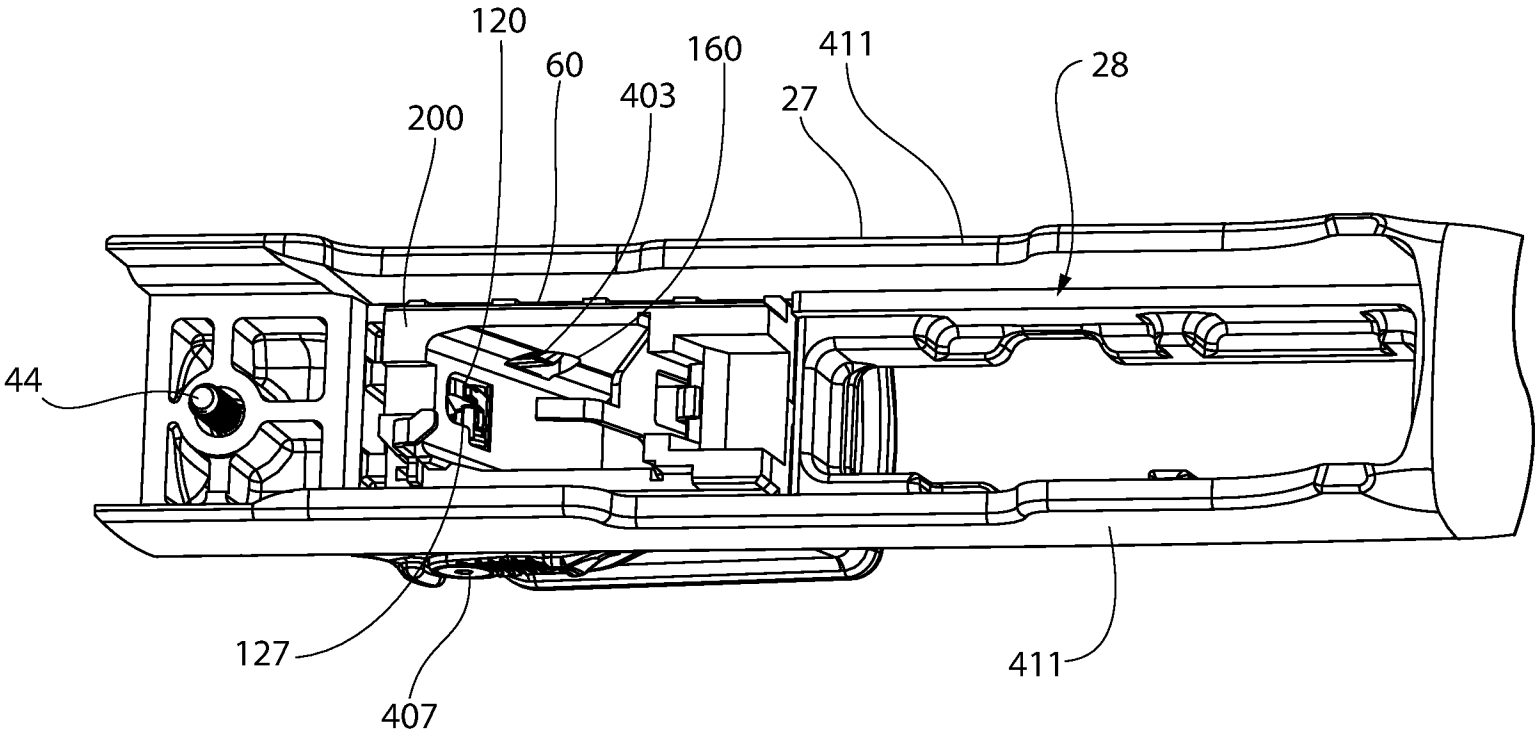
FIG. 39 is a top perspective view showing the second magazine well insert mounted in the firearm mid-stock.
Figure 40:
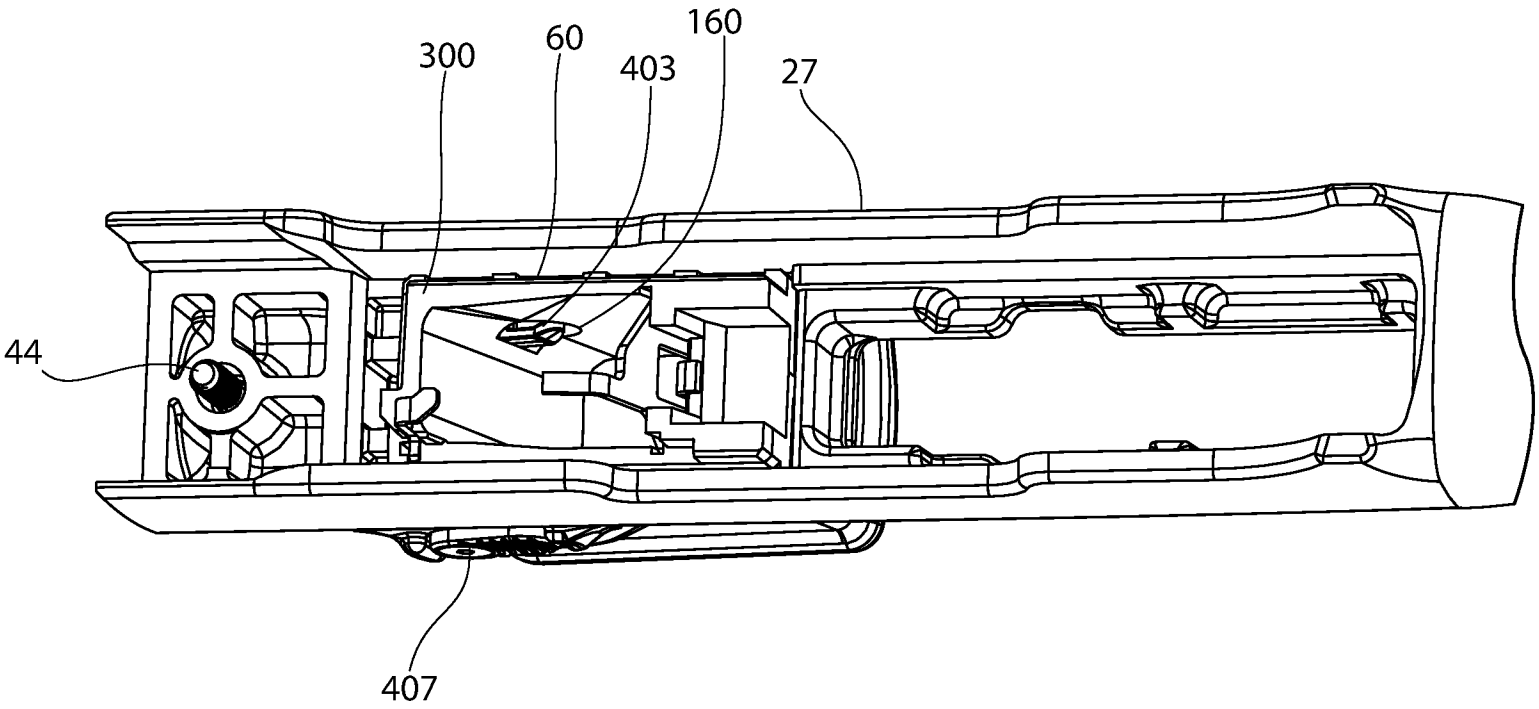
FIG. 40 is a top perspective view showing the third magazine well insert mounted in the firearm mid-stock.

FIGS. 36 and 37 show the process for mounting one of the magazine well inserts 100 in the mid-stock 27 of the firearm. The process and sequence is the same for any of the magazine well inserts 100, 200, or 300 which all have the same general configuration, dimensions, and common mounting interface in a preferred but non-limiting embodiment. In FIG. 36, magazine well insert 100 is first positioned above the mid-stock 27 and aligned with receptacle 60 of the stock. The insert 100 is then inserted into the receptacle until the downward facing bearing surfaces 111 abuttingly engage corresponding upward facing longitudinal and linear seating surfaces 115 formed in the mid-stock 27 within the open receptacle 60 (see also FIG. 41). A laterally spaced apart of pair of the seating surfaces 115 are provided for this purpose to match the spacing of the two peripheral mounting flanges 110 on the insert 100. In one embodiment, the bottom 107 of the magazine well insert 100 may be substantially flush with the bottom of the receptacle 60 (see, e.g. FIG. 5). FIGS. 38-40 show a top view of the mid-stock 27 with each of the magazine well inserts 100, 200, and 300 alternatively positioned in the mid-stock.

Figure 41:
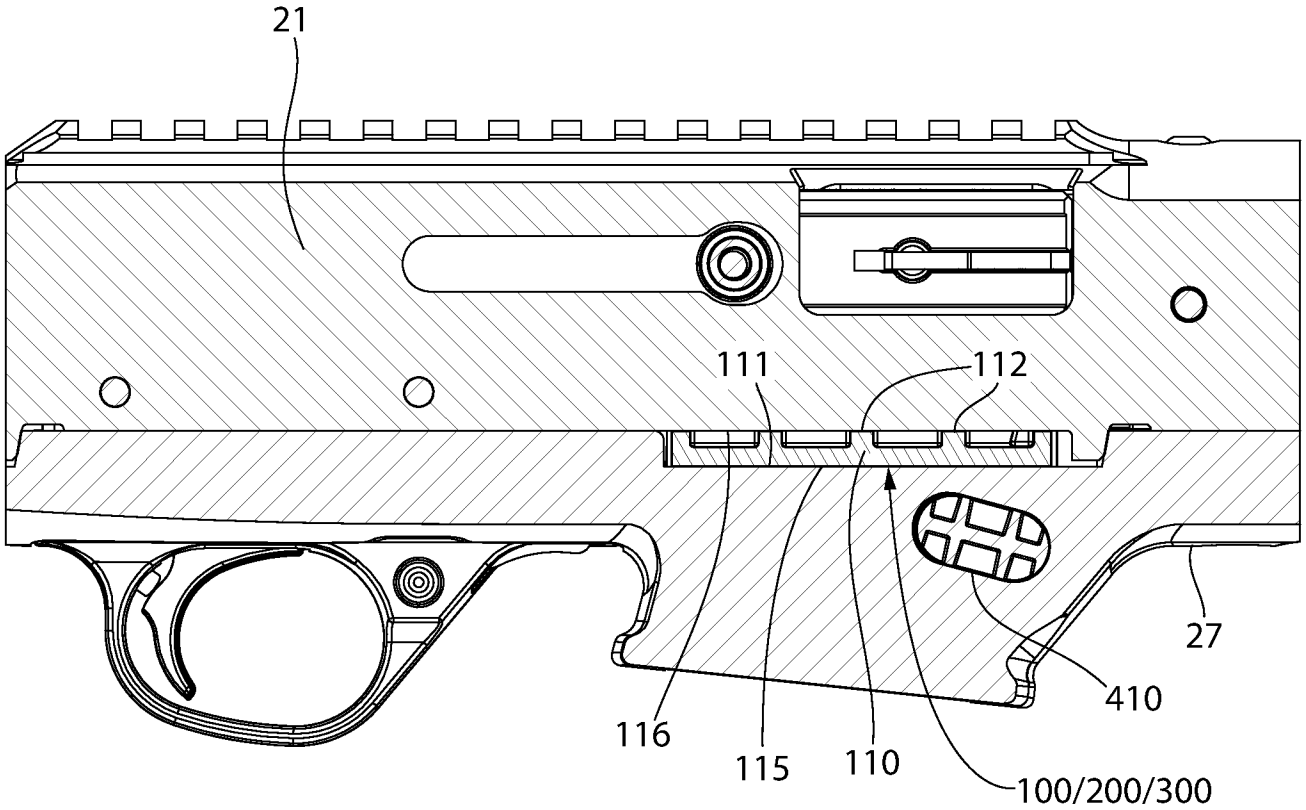
FIG. 41 is a right side cross-sectional view showing either of the first, second, or third magazine well inserts fully mounted and held in the mid-stock of the firearm via a common mounting interface.

Next, the receiver 21 is positioned over and fully lowered into the mid-stock 27. This engages a pair of downward facing longitudinal and linear locking surfaces 116 formed on a bottom portion of the receiver with the upward facing top bearing surfaces 112 of magazine well insert 100, as shown in FIG. 41. The mounting flanges 110 of magazine well insert 100 are thus interposed and trapped between the seating surfaces 115 of mid-stock 27 and locking surfaces 116 of receiver 21. The receiver 21 may then be coupled to the mid-stock 27 in a removable manner using threaded mounting fasteners 44 previously described. As the fasteners are tightened, the receiver 21 is drawn downwards into engagement with the mid-stock, thereby compressing and trapping the mounting flanges 110 of magazine well insert 100 therebetween to complete the securement (see, e.g. FIGS. 37 and 41). Accordingly, additional or separate fasteners beyond using the receiver mounting fasteners 44 are not required to secure the magazine well inserts to the stock of the firearm. To remove the magazine well insert 100 and insert one of the other inserts, the foregoing process is simply reversed and repeated.

In one embodiment, the mounting flange 110 may have a castellated top configuration such that the top bearing surface 112 of each flange is collectively defined by a plurality of longitudinally spaced apart protrusions 114 as shown. The castellated arrangement facilities molding of the magazine well inserts, and may compensate for any surface irregularities between the mating bearing surfaces formed on the flanges and bottom of the metallic receiver to ensure a tight fit-up when the fasteners 44 are tightened. In other embodiments, the castellations may be omitted.

Referring to FIGS. 5-14, magazine well insert 100 may further comprise a front latch lever 120, ejector 130, and last round hold open actuator 140. The front latch lever 120 is pivotably mounted to the front wall 101 of magazine well insert 100 via a horizontal transversely mounted pivot pin 121. In certain embodiments, pin 121 may be mounted slightly formed of front wall 101 of magazine well insert on a pair of frontal projections 128 so that the front latch lever 120 is pivotably movable to project partially rearward into the open central cavity 105 of the insert 100 for retaining a magazine 150 therein, and to retract forwards from the cavity for releasing the magazine when actuated. Latch lever 120 includes an upwardly extending latching arm 122 above pivot pin 12 and a downwardly extending operating arm 123 below the pin. Latching arm 122 includes a rear latch protrusion 124 that movably projects rearwards through a front window 127 in front wall 101 of magazine well insert 100 into the central cavity 105 to engage a front catch or retention feature 153 such as a catch surface formed on the front wall of magazine 150. Operating arm 123 includes a forwardly extending camming protrusion 125 on an end thereof which is configured and arranged to engage latch stud 400 used to operate the lever, as further described herein.

Latch lever 120 is pivotable about pin 121 via operation (i.e. sliding) of the latch stud 400 between a rearward latched position in which latch protrusion 124 engages magazine 150 when positioned in magazine well insert 100, and a forward unlatched position in which the latch protrusion disengages and releases the magazine from the central cavity 105 of the magazine well insert 100. Pin 121 defines a pivot axis horizontally and transversely oriented to the longitudinal axis LA. This provides a vertical orientation for the front latch lever 120 and forward/rearward pivoting action of the lever about the pivot axis. Latch lever 120 is biased towards the latched position by spring 126 mounted about pin 121. In one embodiment, spring 126 may be a torsion spring; however, other types of springs may be used (e.g. helical compression springs, etc.).

The latching arm 122 of front latch lever 120 may include a rear facing over-rotation stop surface 129. Stop surface 129 may be located above latch protrusion 124 on the latching arm in one embodiment. The over-rotation stop surface 129 is positioned for engaging the front wall 101 of the magazine well insert 100 above window 127 to prevent the latch protrusion 124 biased rearward by spring 126 from protruding too far or deep into the interior of the magazine well insert.

In one embodiment, pivot pin 121 of latch lever 120 and its corresponding pivot axis are positioned above and parallel to the latch stud 400 in the mid-stock 27 when magazine well insert 100 is positioned in the mid-stock. In one non-limiting embodiment, the front latch lever 120 may be approximately centered on the front wall 101 of magazine well insert 100 approximately midway between the lateral sidewalls 103, 104 for proper positioning to engage the front latch feature or surface 153 on front latch style magazine 150. The positioning of the front latch lever 120 may thus be selected to match the location of the retention features of the specific types of magazine intended to be used with the magazine well insert 100.

Referring to FIGS. 6-14, the ejector 130 may be fixedly mounted on rear wall 102 of the magazine well insert 100. Ejector 130 in one configuration has a flattened and plate-like metallic main body including a forwardly angled cantilevered shell-engagement projection 131 oriented obliquely to the main body. Ejector 130 is positioned to contact the base end of an extracted spent shell casing when the action is cycled. This deflects the casing laterally outwards through an ejection port 159 on the side of the receiver 21. The shell casing is extracted from the barrel chamber after firing by an extractor (not shown) mounted on the bolt assembly 50. Projection 131 may extend upwards beyond the top of the magazine well insert 100 and may be positioned at least partially over the top opening 103 of the insert as shown.

Figure 42:
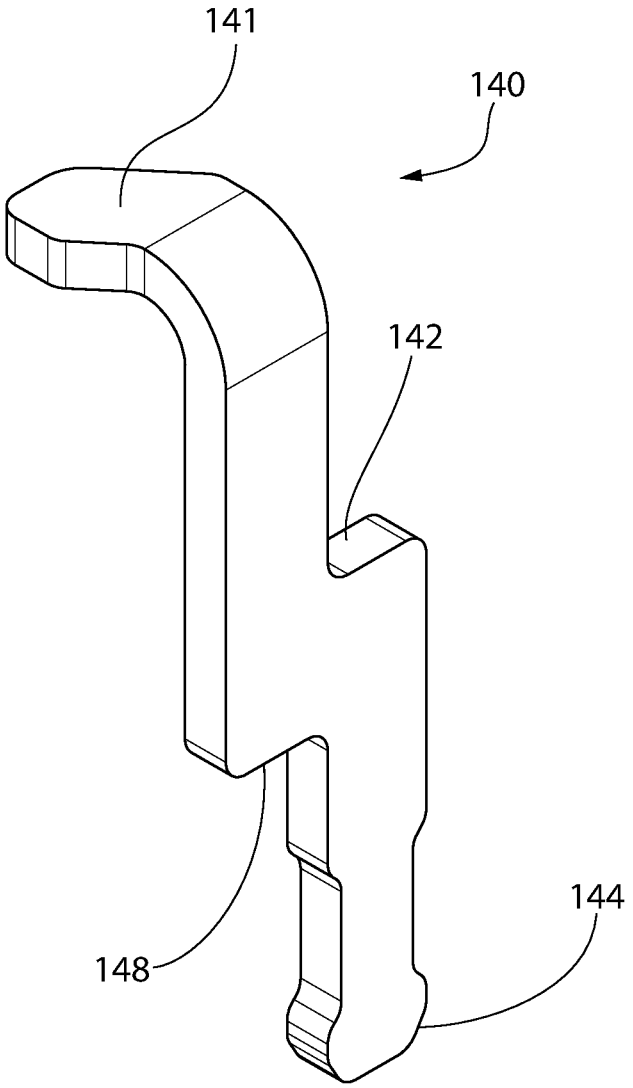
FIG. 42 is perspective view of a last round hold open actuator provided with each of the first, second, and third magazine well inserts.
Figure 43:
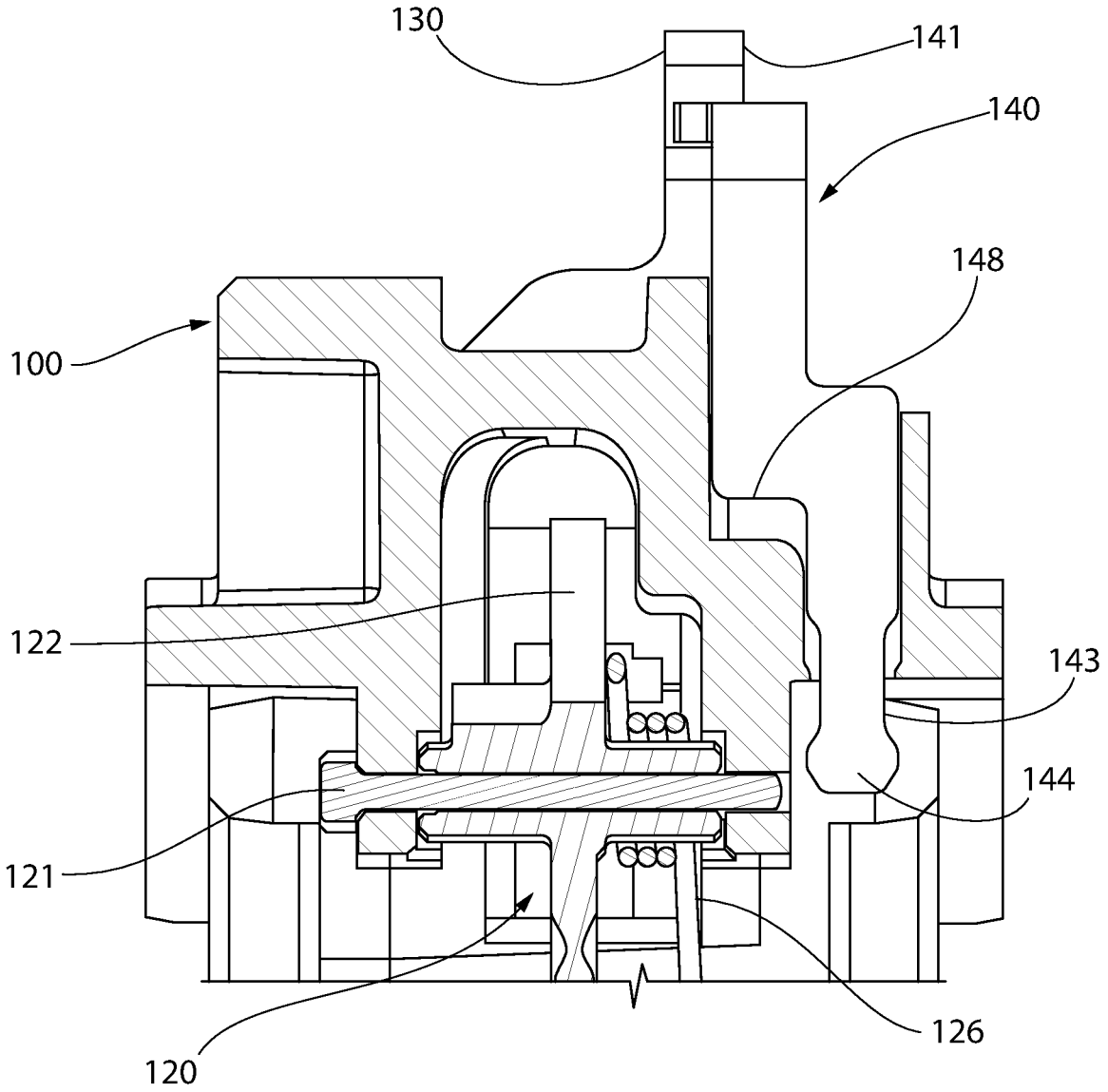
FIG. 43 is a transverse cross-sectional view of the well insert of FIGS. 7-14 showing the hold open actuator and latching lever assembly.

With additional reference to FIGS. 42 and 43, last round hold open actuator 140 may act as a plunger having a vertically elongated and substantially linear metallic body. The actuator body includes a rearwardly-projecting angled top operating end 141 and a opposite bottom end 144. Bottom end 144 may be laterally enlarged and bulbous in configuration, thereby forming a retention protrusion having a width larger than the corresponding opening or slot 143 in the body of magazine well 100 through which the actuator extends and slides upwards/downward. This retention protrusion keeps the actuator from falling out when the magazine well assembly is not in the firearm. The actuator 140 is slideably received in vertical through slot 143 formed through the upper portion of the magazine well insert 100. In one embodiment, slot 143 may be formed through the left peripheral mounting flange 110 of magazine well insert 100. The top operating end 141 of the hold open actuator 140 extends upwards from the slot 143 above mounting flange 110. The bottom end 144 extends downwards from the slot below mounting flange 110.

An upward facing horizontal actuation surface 142 extends laterally outwards from the actuator body between the ends 141, 144. In one embodiment, the actuation surface 142 may be defined by a lateral offset in the actuator body between an upper linear portion defining operating end 141 and a lower linear portion defining bottom end 144 (best shown in FIG. 42). This offset further defines a downward facing seating surface 148 when engages a mating seating surface formed by mounting flange 110 of magazine well insert 100 within through slot 143 that prevents the hold open actuator 140 from dropping downwards through the slot. When the magazine well insert 100 is positioned in the firearm mid-stock 27, the actuation surface 142 is interposed between the top 106 of the magazine well insert body and a longitudinally elongated hold open lever 145 pivotably mounted about cross pin 146 in the receiver 21. In one embodiment, cross pin 146 may be disposed in the barrel block sub-assembly 33 of the receiver 21. Hold open lever 145 has a front end coupled to cross pin 146 and a rear engagement end 147 arranged to engage a hold open notch 155 formed on the bottom of the bolt assembly 50 (best shown in FIGS. 6A and 6B).

Figure 6A:
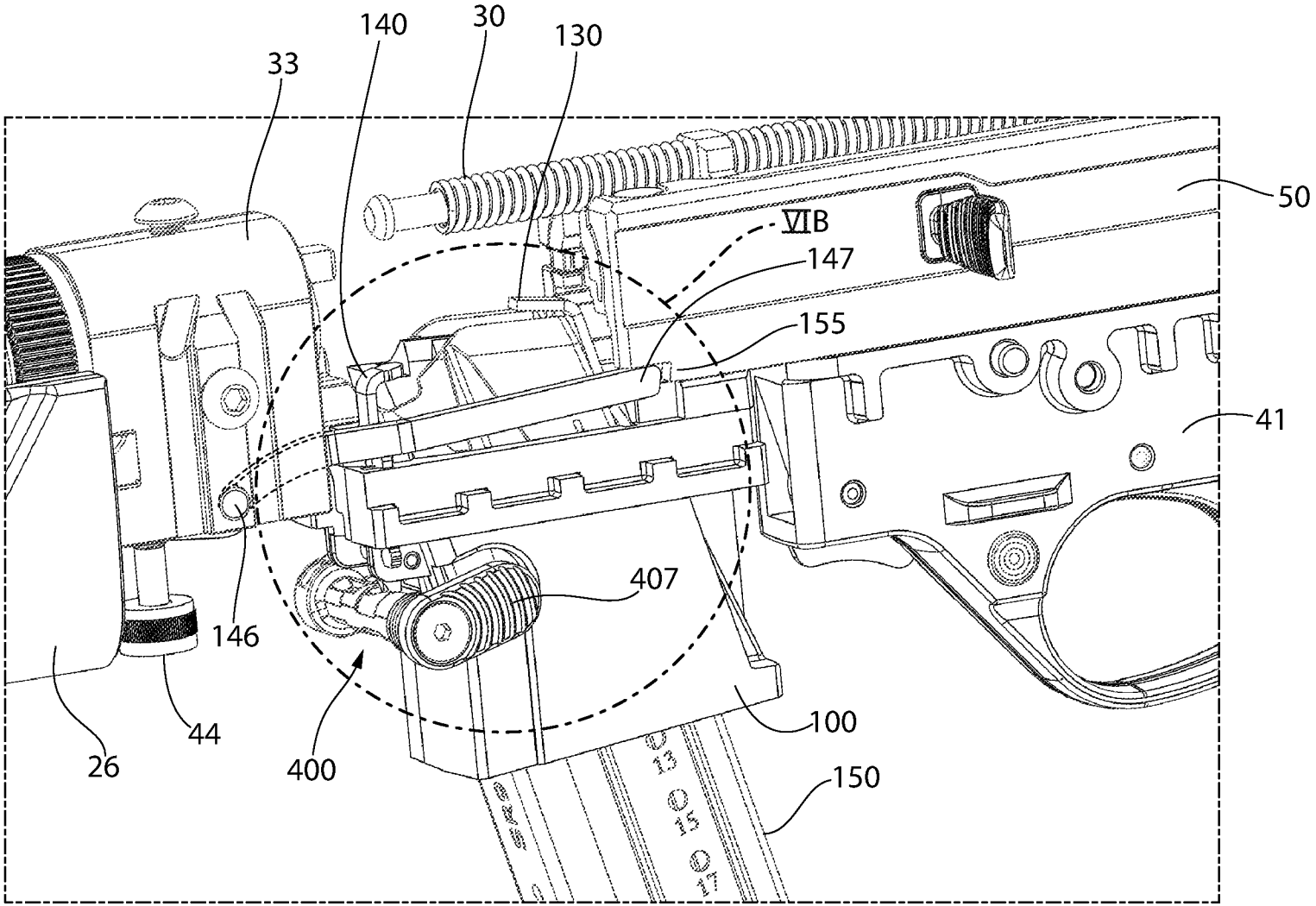
FIG. 6A is a left side perspective view of the action portion of the firearm with mid-stock removed to better show the receiver, trigger assembly, magazine well insert, and universal latch stud.
Figure 6B:
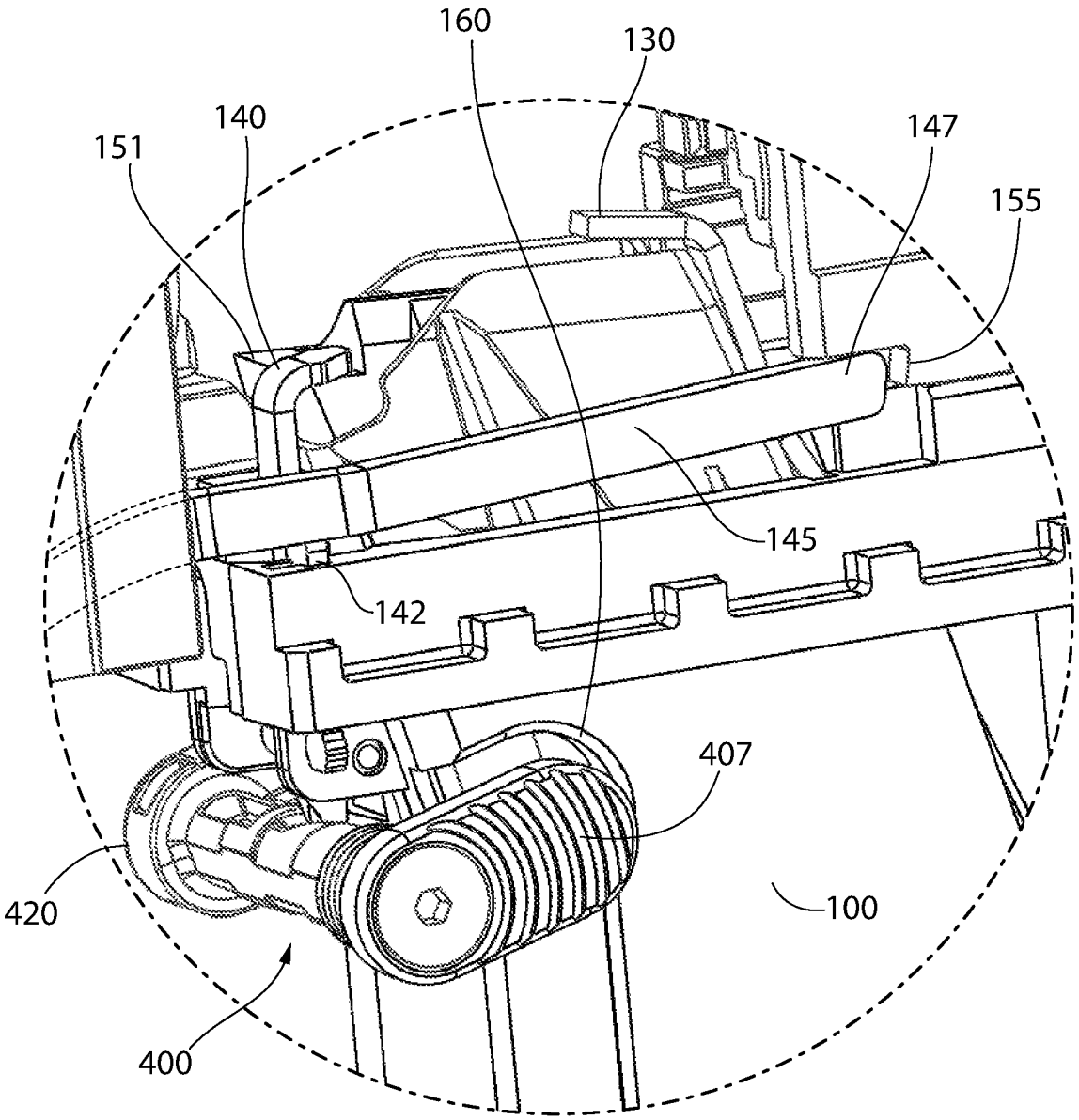
FIG. 6B is an enlarged detail taken from FIG. 6A.
Figure 7:
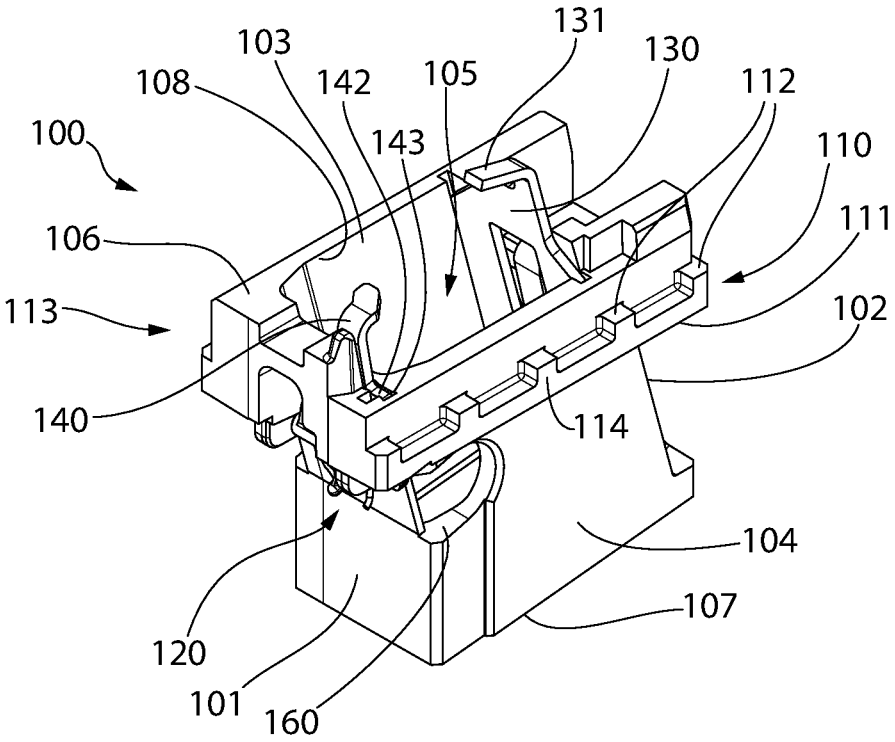
FIGS. 7-14 show various views of a first magazine well insert for front latching magazines useable with the magazine well insert system according to the present disclosure.
Figure 8:
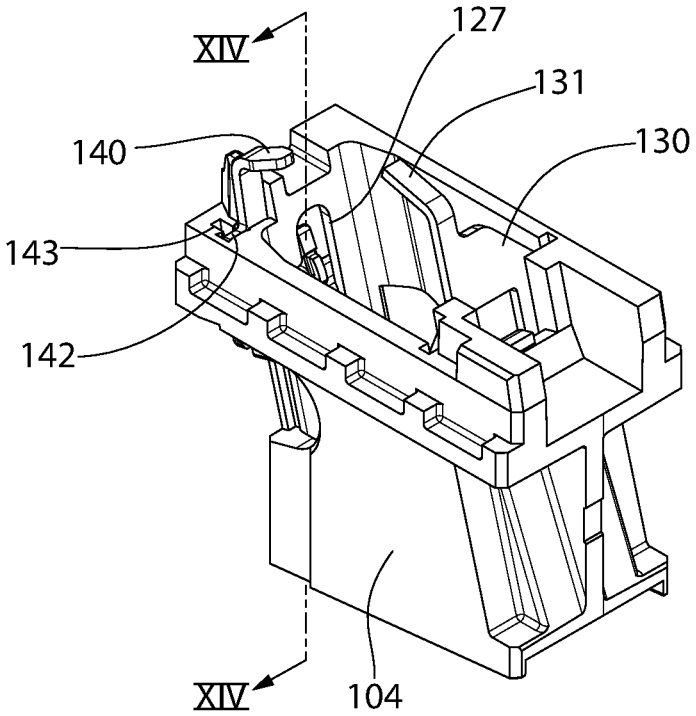
Figure 9:
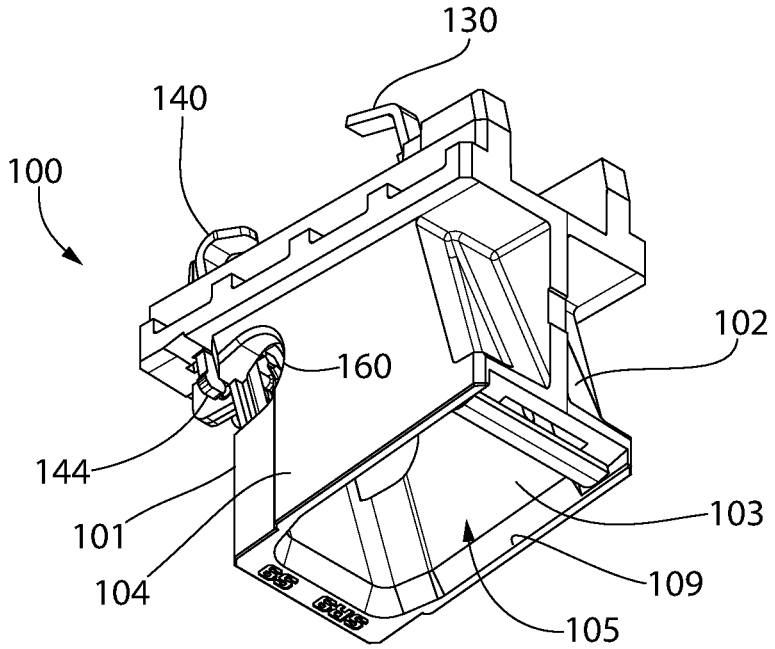
Figure 10:
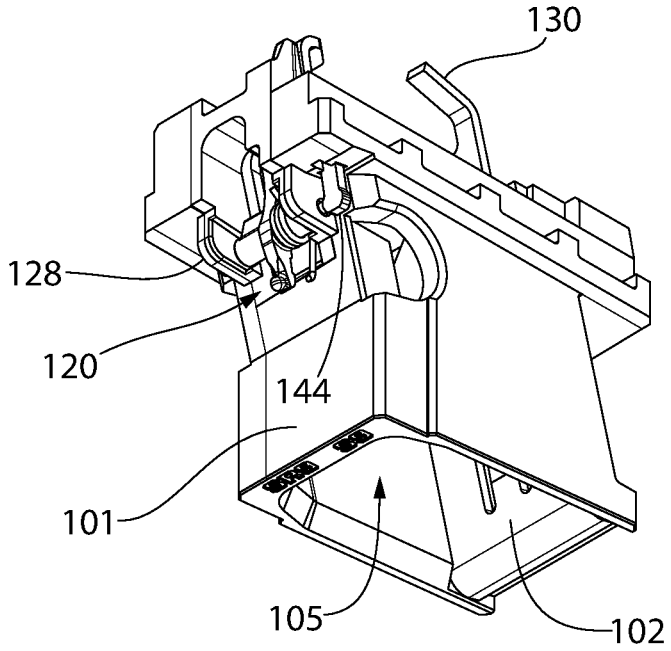
Figure 11:
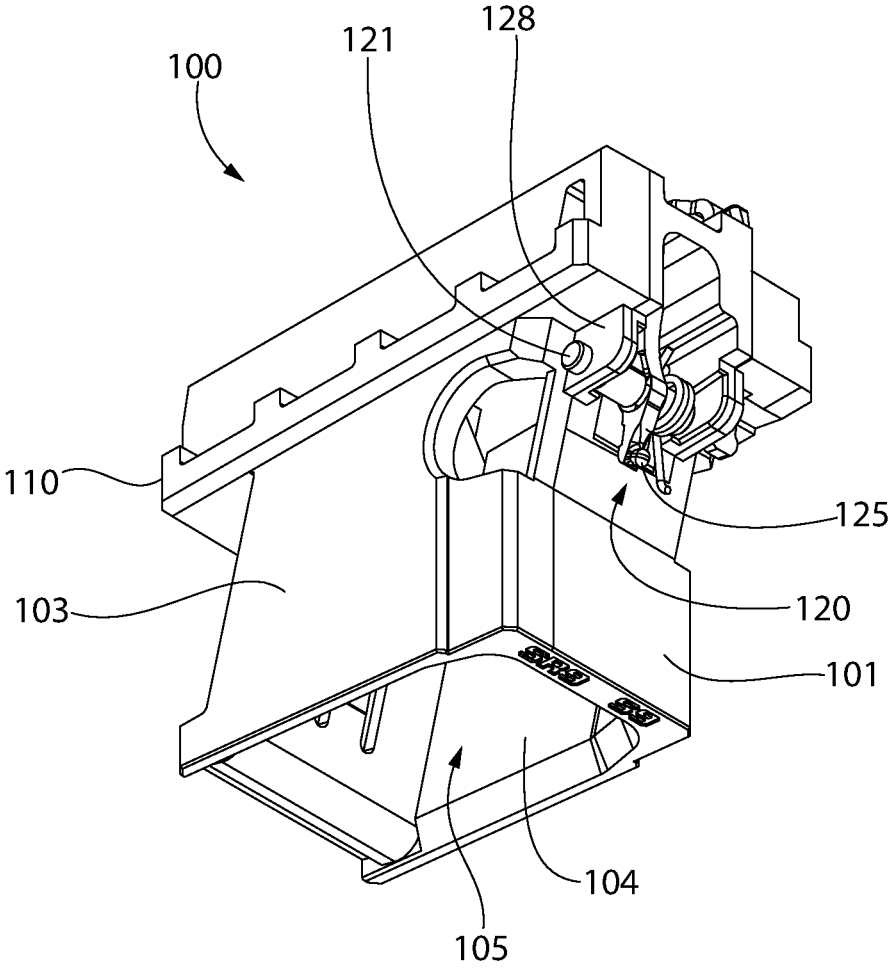
Figure 12:
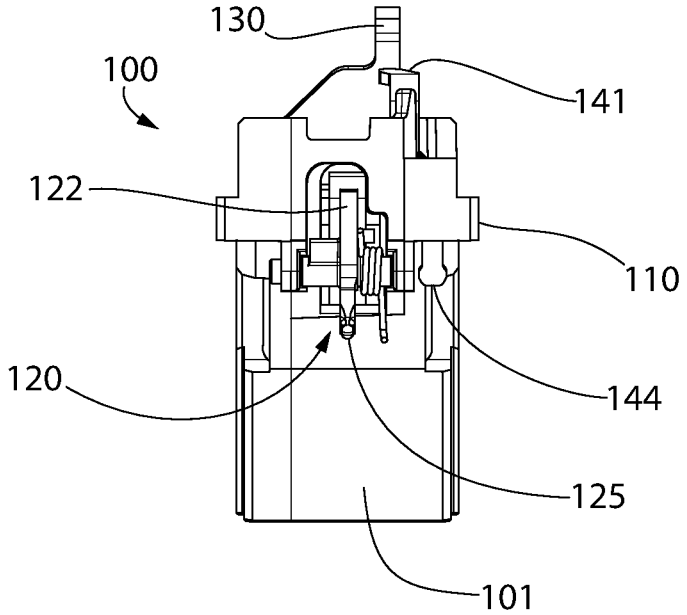
Figure 13:
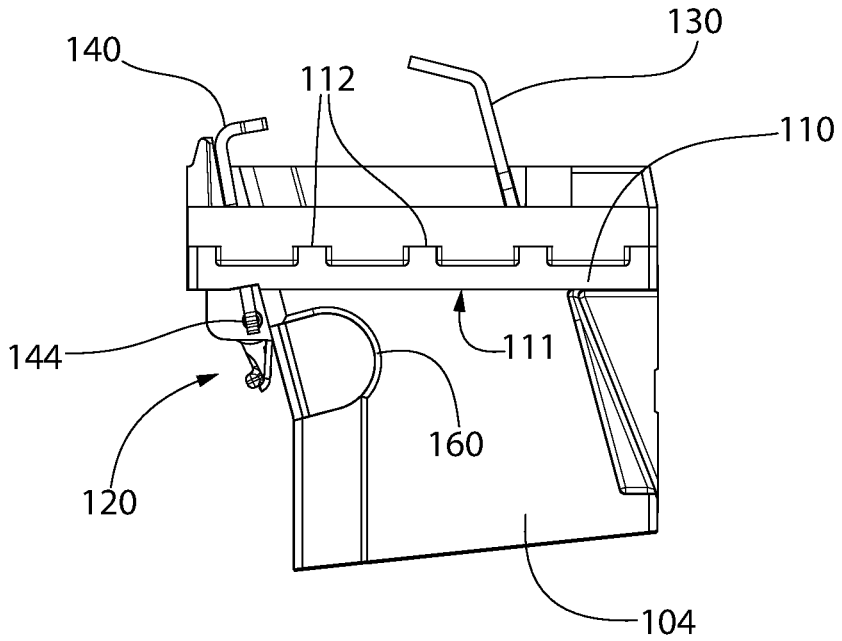
Figure 14:
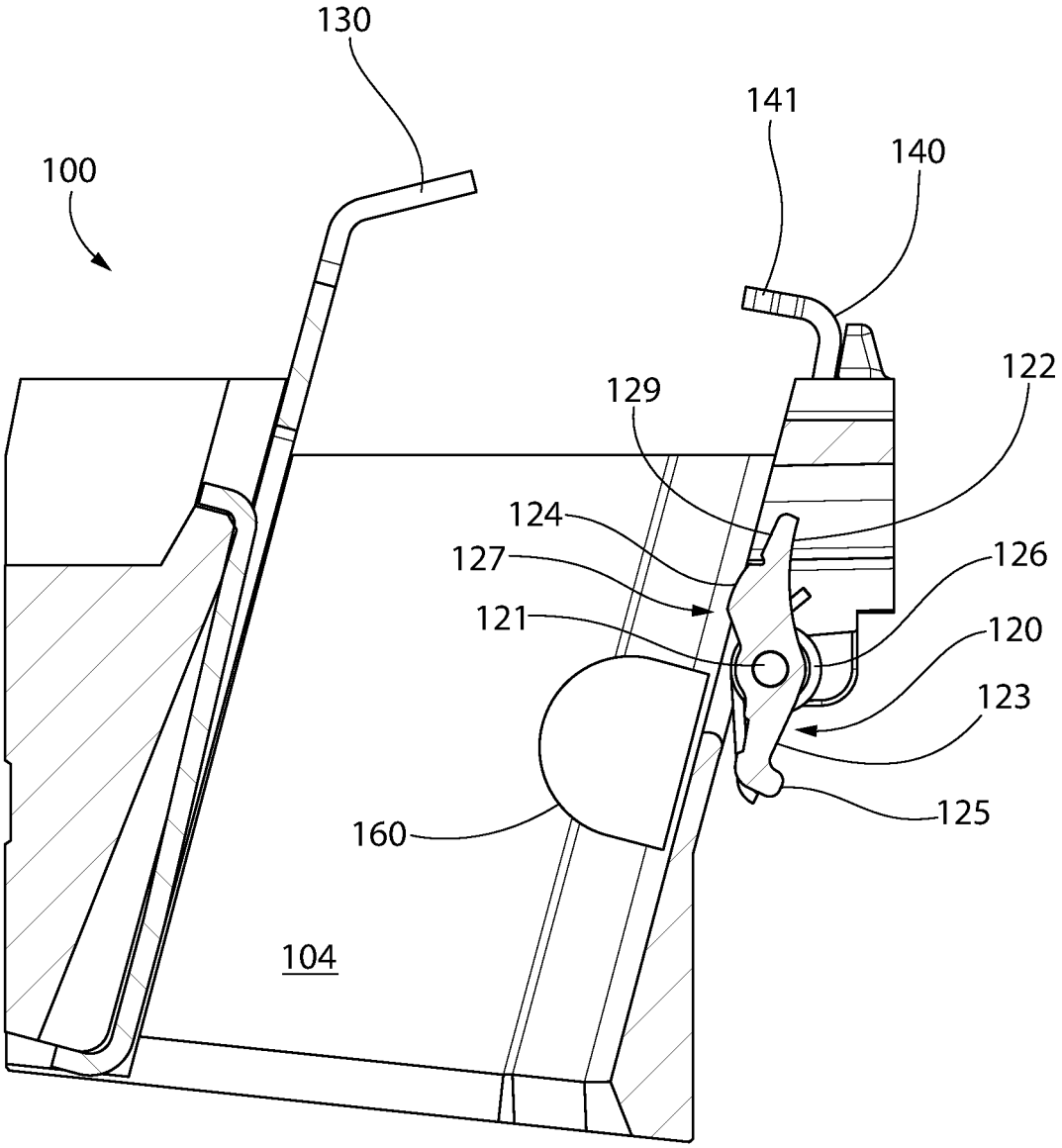
Figure 15:
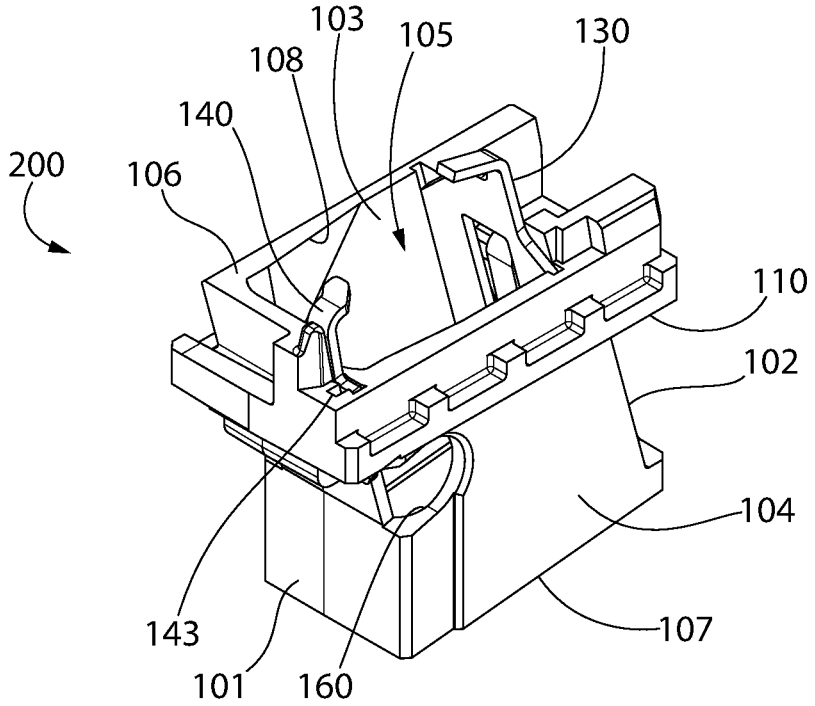
FIGS. 15-21 show various views of a second magazine well insert for side latching magazines useable with the magazine well insert system according to the present disclosure.
Figure 16:
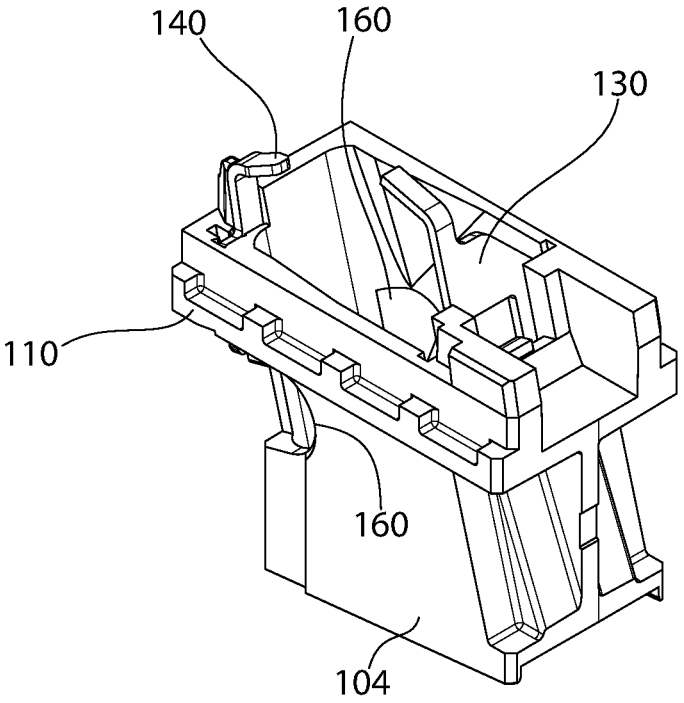
Figure 17:
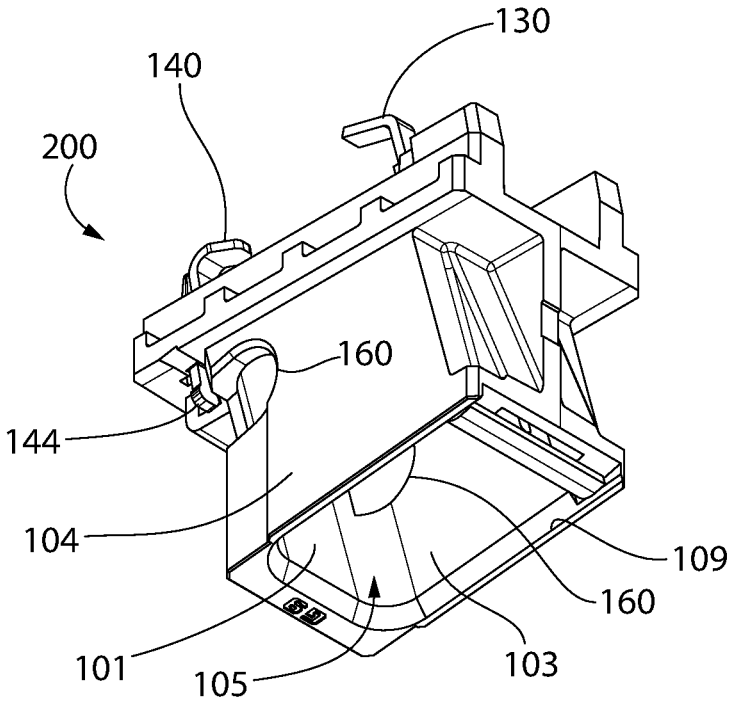
Figure 18:
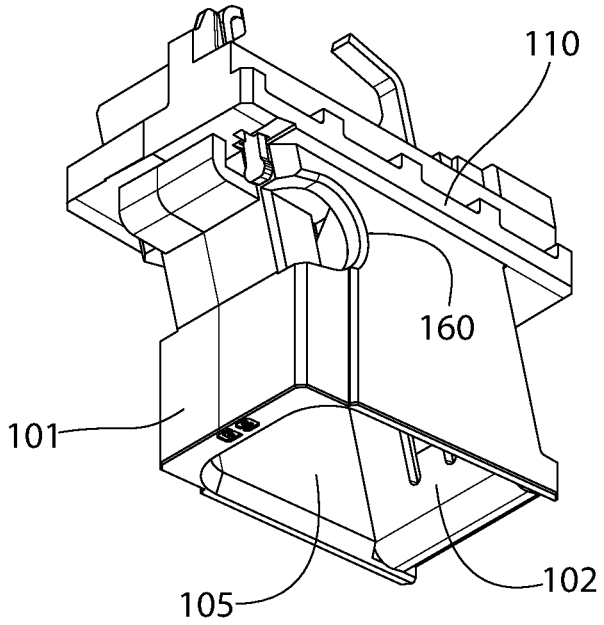
Figure 19:
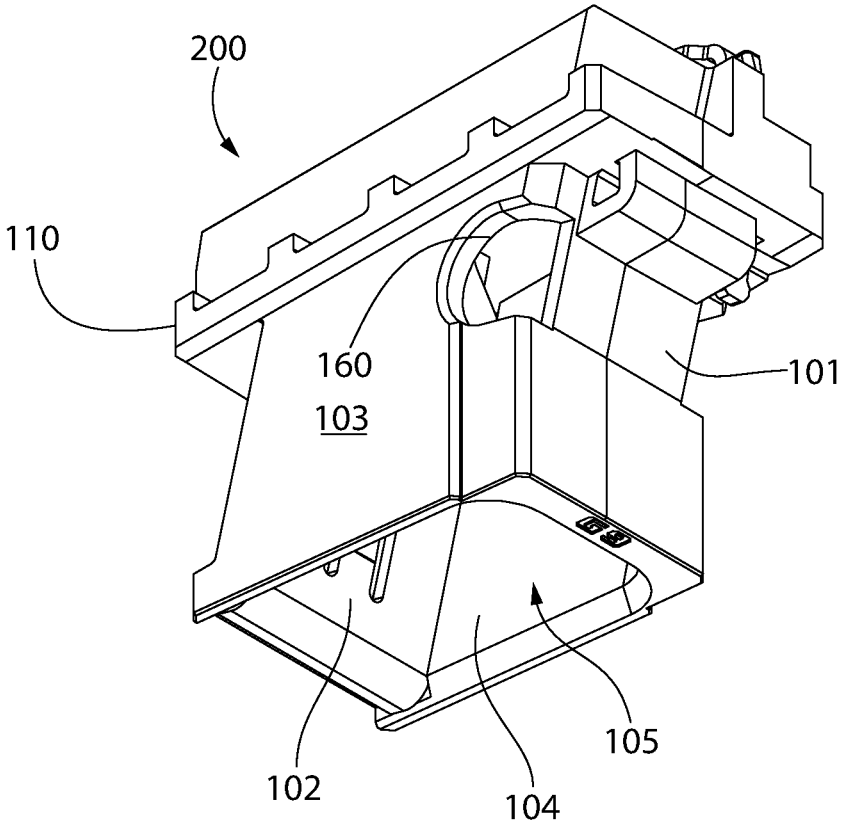
Figure 20:
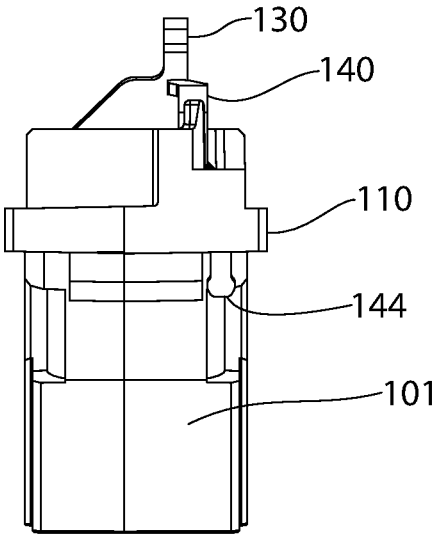
Figure 21:
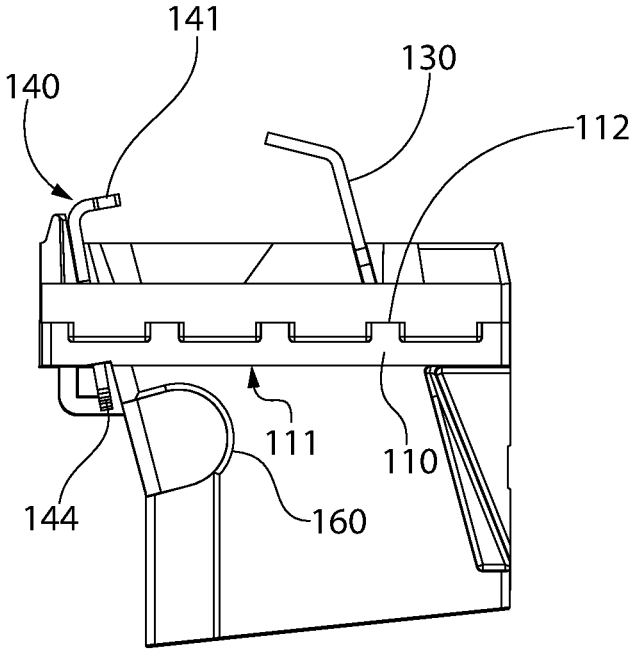
Figure 22:
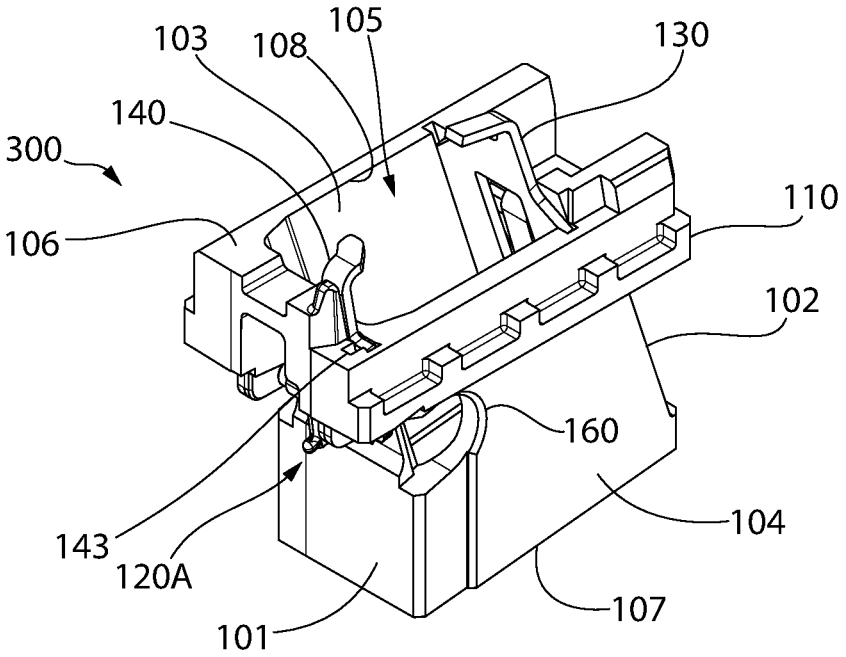
FIGS. 22-29 show various views of a third magazine well insert for front latching magazines useable with the magazine well insert system according to the present disclosure.
Figure 23:
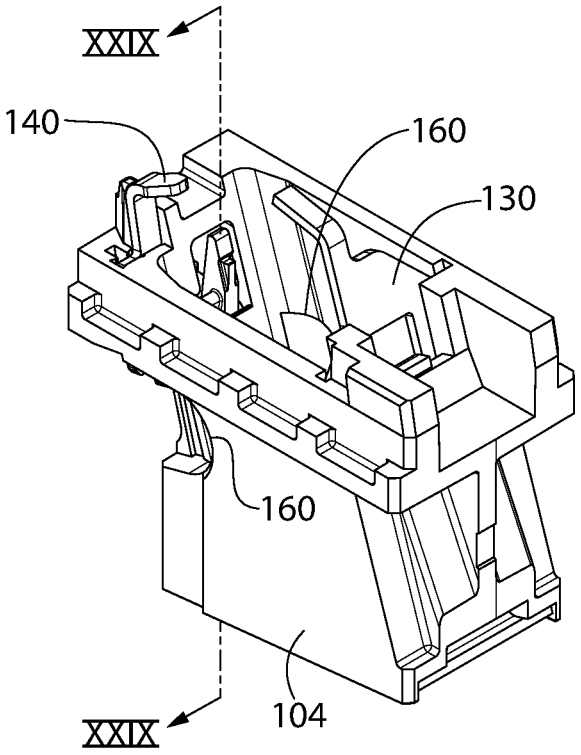
Figure 24:
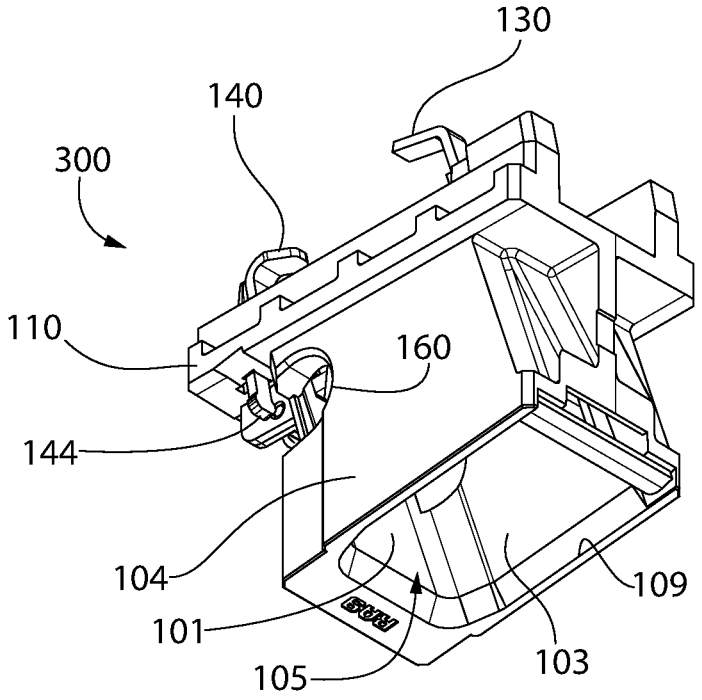
Figure 25:
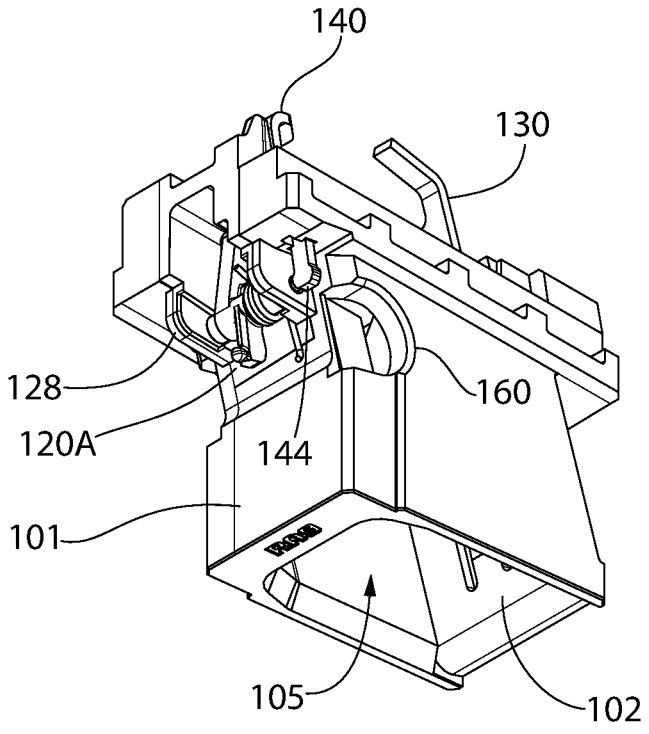
Figure 26:
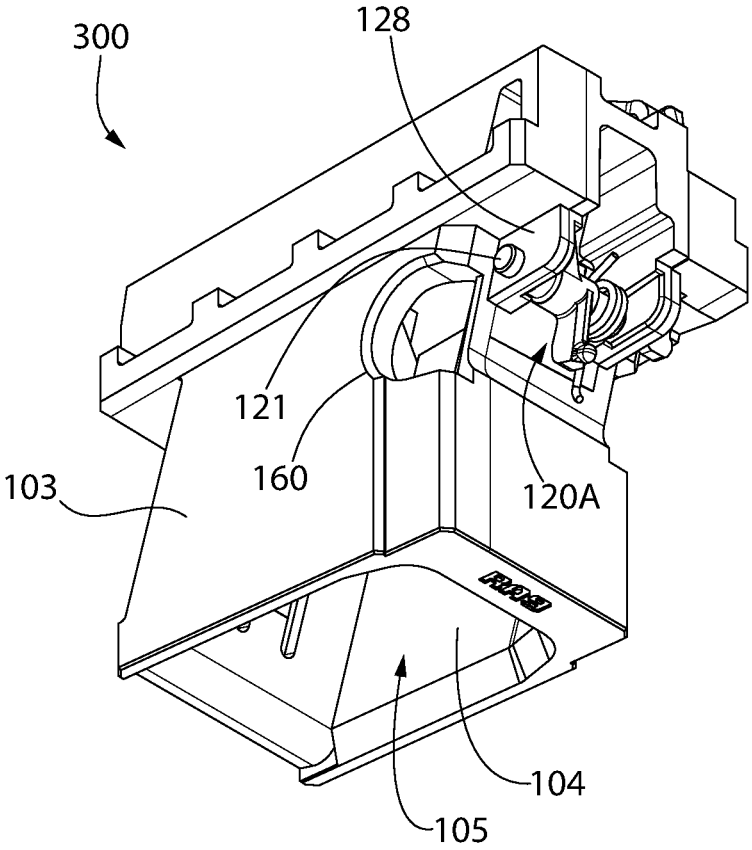
Figure 27:
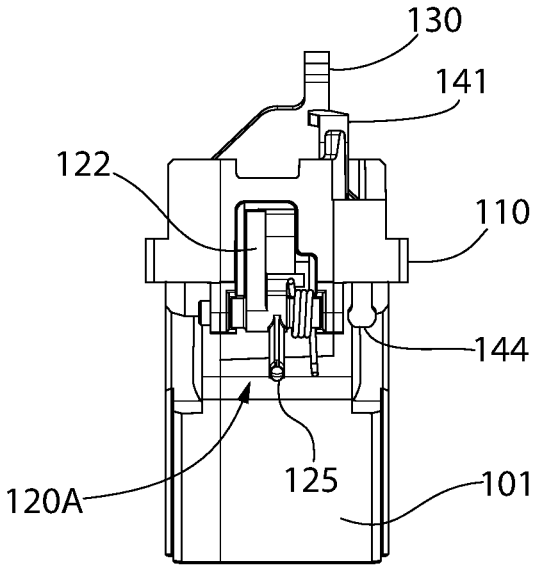
Figure 28:
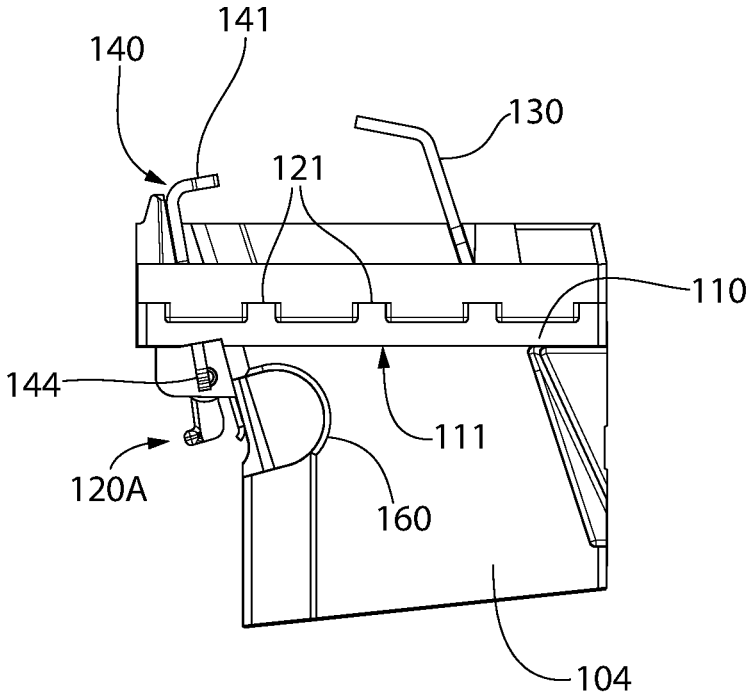
Figure 29:
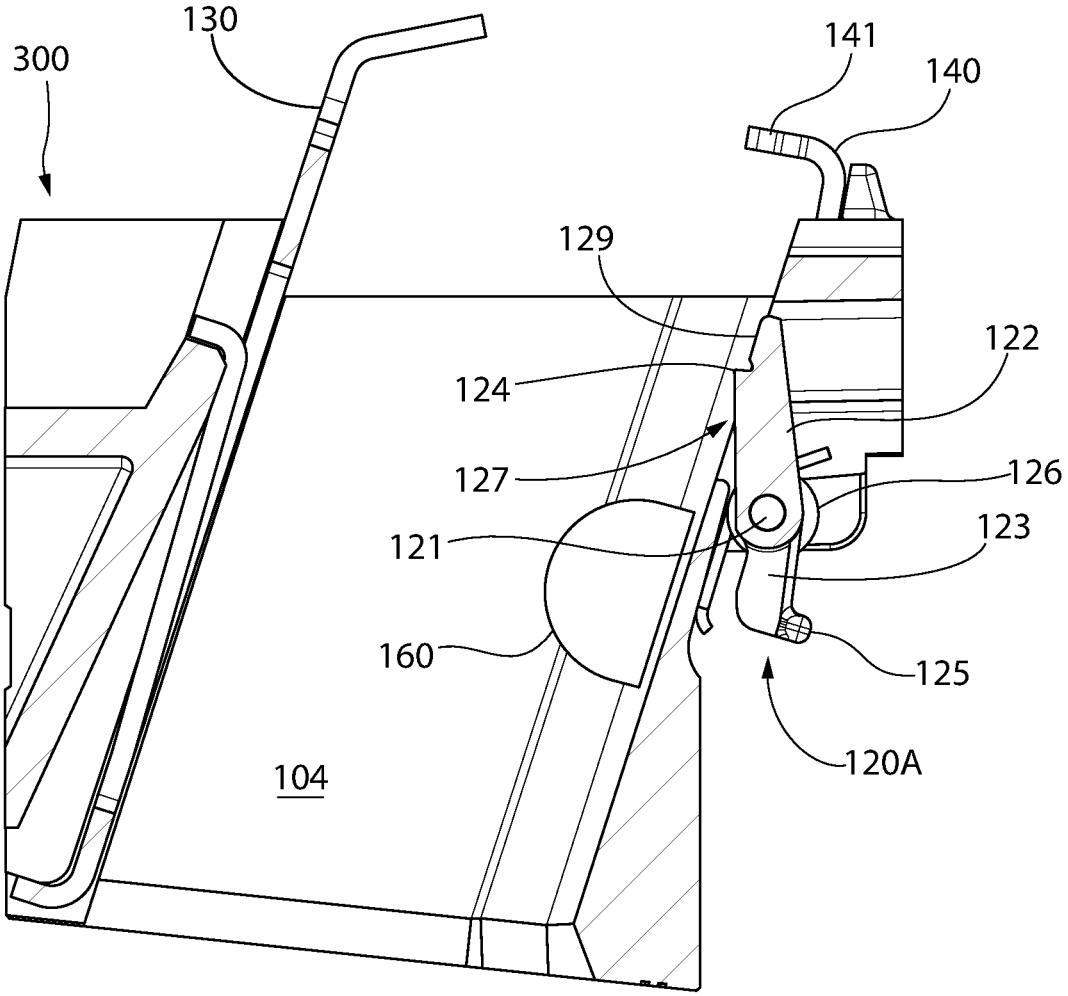

Hold open lever 145 is movable between a lower non-blocking position in which the bolt assembly 50 is free to move forward to a closed breech position in battery with the rear breech end of the barrel, and an upper blocking position engaging the bolt assembly as shown in FIGS. 6A and 6B). A spring (not shown) biases the lever 145 to the lower non-blocking position. Therefore, when the empty magazine is removed and the bolt is pulled rearward, the lever drops and the bolt is free to travel forward again. In operation when the last round of ammunition is fired from the magazine 150, the breech will open and the bolt assembly 50 will travel fully rearward under recoil. With an empty magazine, the magazine follower 151 can travel all the way upwards in the magazine tube and contact the top operating end 141 of the hold open actuator 140. This forces the actuator 140 upwards, which in turn lifts or raises the hold open lever 145 moving it to the upper blocking position via engagement with the actuation surface 142 on actuator 140 as described above. The bolt assembly 50 is unable to move fully forward and close the breech due to engagement between the hold open lever 145 and the hold open notch 155 on the bolt assembly. The breech thus remains open, signaling the operator to release the magazine and load a new loaded magazine into the magazine well insert 100.

Magazine well insert 300 is shown in FIGS. 22-29. Magazine well insert 300 is substantially the same in all respects to magazine well insert 100 described above, with exception of the front latching lever which is slightly different in configuration. Magazine well insert 300 is designed for use with a magazine 350 having a front catch feature 351 as well (see, e.g. FIG. 46), but in which the catch feature is laterally offset from the vertical centerline CL of the magazine well insert. Whereas the operating arm 123 and latching arm 122 of latch lever 120 of magazine well insert 100 are vertically and axially aligned (see, e.g. FIGS. 12 and 34), the operating and latching arms 123 and 122 of alternative latching lever 120A provided with magazine well insert 300 are laterally and vertically offset (see, e.g. FIGS. 27 and 35) to accommodate the off-center catch feature 351. Other than this difference, the other features of latch lever 120A are the same as latch lever 100 already described and will not be repeated here for sake of brevity.

Magazine well insert 200 is shown in FIGS. 15-21. This insert is designed for use with side latching magazines 250 having a side catch or retention feature 251. Accordingly, insert 200 does not include a latch lever of any type like inserts 100 and 300. Instead, the lateral aperture 160 formed through the right lateral sidewall 103 of the magazine well insert body allows the side latch protrusion 403 of latch stud 400 to be projected inwards into the insert 200 to engage the side catch or retention feature 251 of side latching magazine 250 via operation of the latch stud. Other than the foregoing differences, magazine well insert 200 is substantially the same in all other respects of construction to magazine well inserts 100 and 300.

Figure 44:
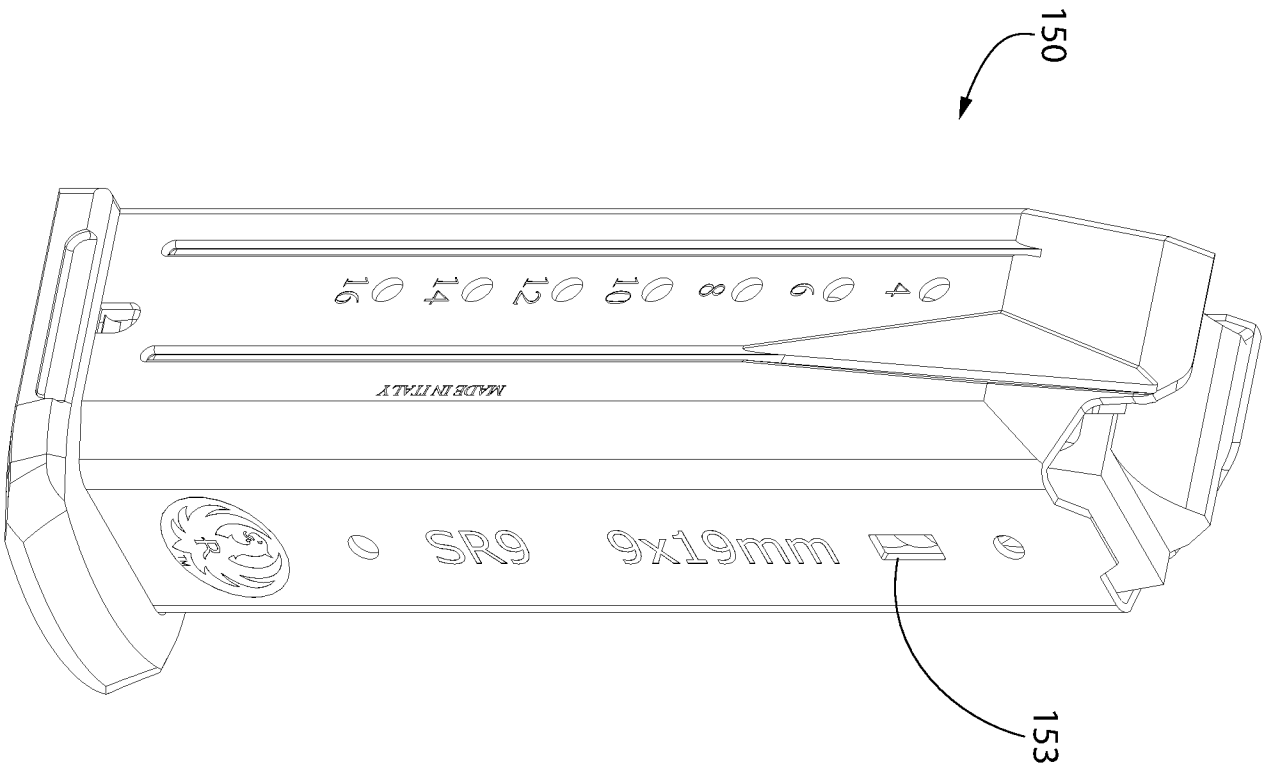
FIG. 44 is a perspective view of a first front latching magazine.
Figure 45:
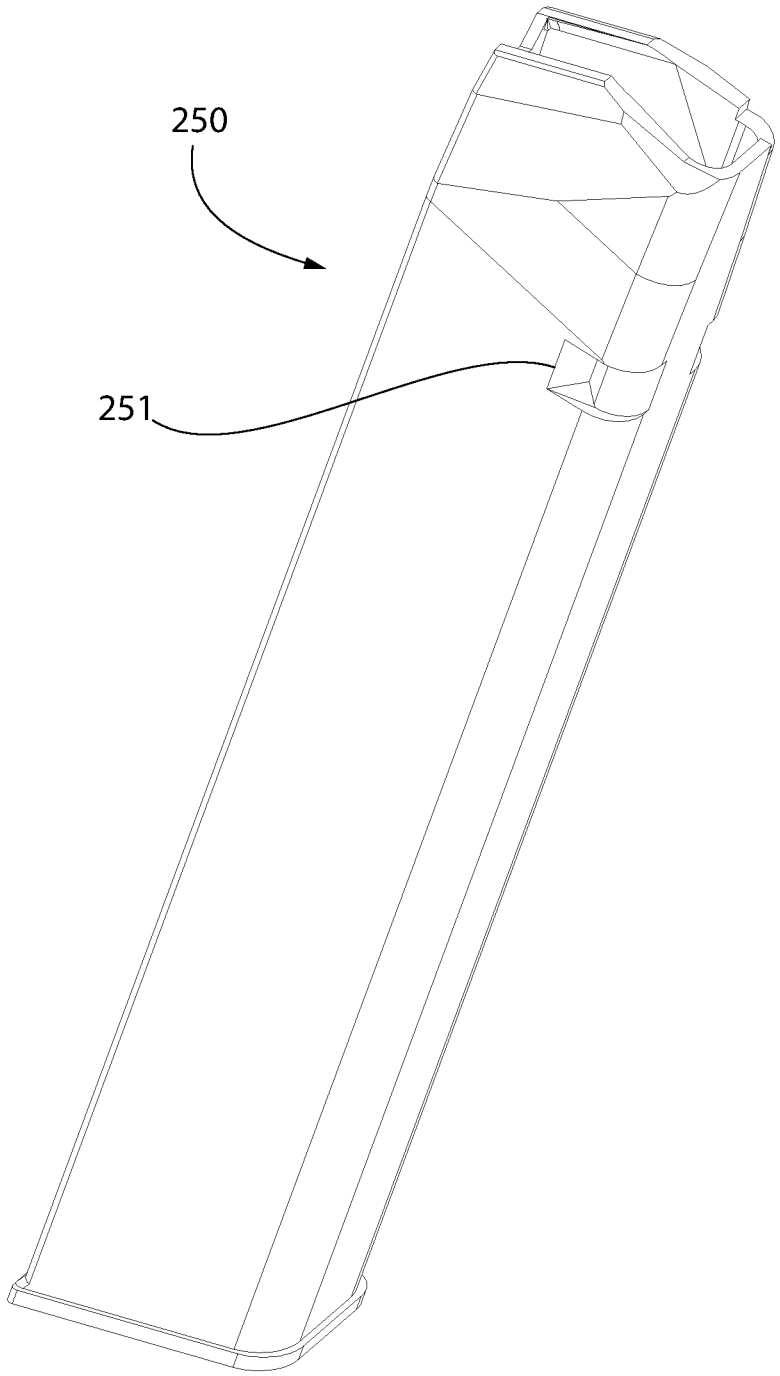
FIG. 45 is a perspective view of a side latching magazine.
Figure 46:
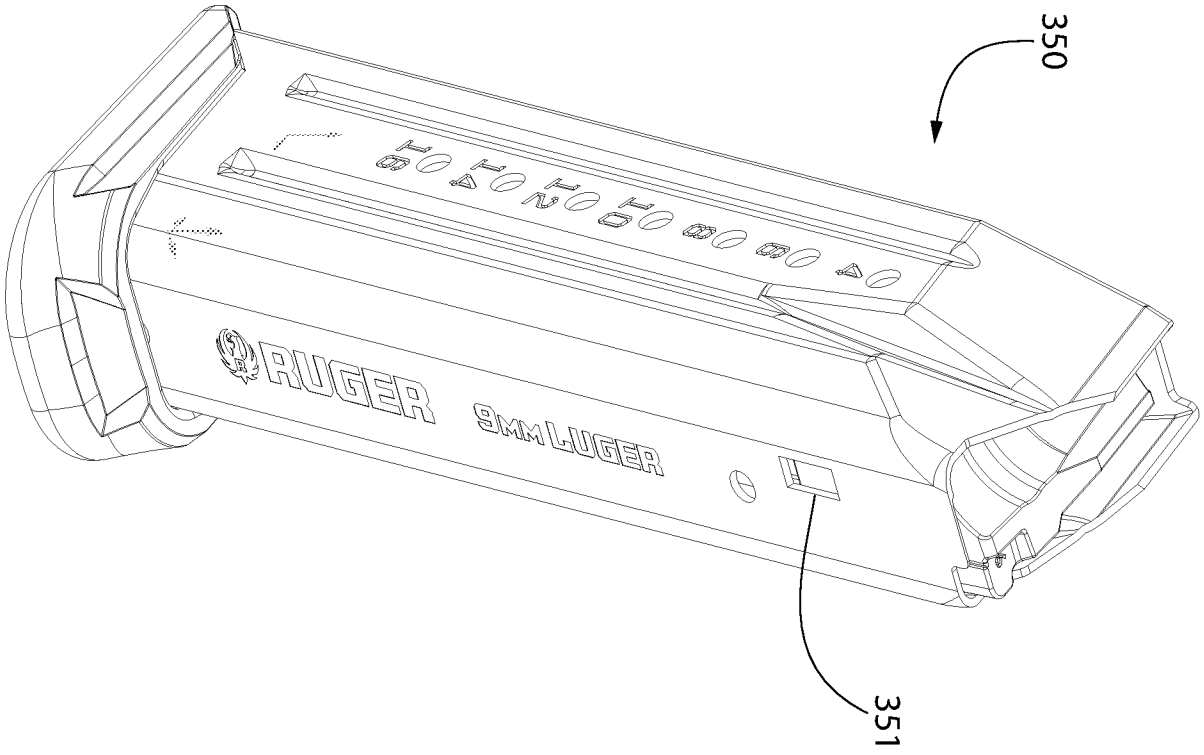
FIG. 46 is a perspective view of a second front latching magazine.

FIGS. 44-46 show magazines 150, 250, and 350 useable with magazine well inserts 100, 200, and 300, respectively. The front latch levers 120 and 120A of magazine well inserts 100 and 300 respectively may be configured to retain a front latch style magazines. For example, magazine well insert 100 with front latch lever 120 is compatible with magazine 150 which may be a 9 mm Ruger® SR9 or S9 magazines (FIG. 44), or other compatible front latching magazines. The retention feature 153 of magazine 150 is laterally centered on the front wall of the magazine between the sidewalls. Magazine well insert 300 with front latch lever 120A of slightly different configuration is compatible with magazine 350 which may be a 9 mm Ruger® RA9 (American Pistol) magazine (FIG. 46), or other compatible front latching magazines. It bears noting that in magazine 350 as shown in FIG. 46, the retention feature 351 is laterally offset slightly to the right side and not centered on the front wall of the magazine case in comparison to magazine 150. In FIG. 44, the retention feature 153 of magazine 150 is centered on the front wall. Retention features 153 and 351 may each comprise an opening or window as shown that defines a retention surface in the magazine tube or case for engaging latch levers 120 or 120A. In other embodiments the retention surface may be formed on a protruding lip or ledge extending forwardly from the front wall of the magazines. Magazine well insert 200 including a left and right latching aperture 160 is compatible with magazine 250 which may be a 9 mm Glock® magazine (FIG. 45) in one example with right or left retention feature, or other compatible side latch style magazines. The right side retention feature 251 of magazine 250 in this case (or other side latching magazines) may be in the form of a recess or an opening/window as shown that defines a retention surface in the magazine tube or case which is engaged by side latch protrusion 403 of the universal latch stud 400, as further described herein.

The universal latch stud 400 mounted in mid-stock 27 of firearm 20 will next be described in further detail. Latch stud 400 is configured to be compatible with an operate the magazine retention mechanisms and features of all three magazine well inserts 100, 200, 300 and corresponding magazines 150, 250, and 350, respectively. FIGS. 30-35 depict the latch stud in isolation for greater clarity. Latch stud 400 has an elongated cylindrical body including an operating end 401, an opposing latching end 402, and a shaft 404 extending between the ends. Latch stud 400 may be transversely mounted in and supported by the mid-stock 27 independently of the magazine well inserts. The latch stud 400 thus remains attached to the mid-stock when the various magazine well inserts are exchanged. Latch stud 400 extends laterally through a side or lateral mounting opening 410 formed in each opposing right and left sidewall 411 of the mid-stock 27 (see, e.g. FIG. 36). The latch stud shaft 404 is slideably supported by a pair of laterally spaced apart support bosses or blocks 500 disposed in the mid-stock 27

(see FIG. 36). Shaft 404 is received through a transverse hole 502 extending laterally through each block 500. The combination of lateral mounting openings 410 and support blocks 500 allows the latch stud 400 to slideably move in a linear manner between the sidewalls 411 of mid-stock 27 from a left locked position to a right unlocked position. Latch stud 400 may be positioned just slightly forward of the magazine well insert receptacle 60 and magazine well insert 100, 200, or 300 when the inserts are mounted in the mid-stock (see also FIGS. 5 and 6) to interface with the front or side latching features of the inserts, as further described herein.

The operating end 401 of latch stud 400 includes a preferably non-circular operating button 407 in one embodiment for actuating the latch stud via a user's finger or thumb. The button 407 may have an oblong shape such as an ovoid or elliptical shape in some configurations which is elongated in the axial direction of the longitudinal axis LA as shown. In other possible embodiments the button may be polygonal or rectilinear in shape. Circular shapes may also be used. The exposed surface of the button 407 may have a textured finish (e.g. knurled, ridges, etc.) to facilitate frictional engagement with a user's finger or thumb to operate the latch shaft more readily. In one embodiment, the button 407 may be a separate component removably mounted to the shaft 404 by any suitable means including a threaded protrusion 408 which engages a threaded socket 409 formed in the operating end 401 of the shaft. Other forms of removable attachment however may be used such as friction fits, adhesives, etc.

The latching end 402 of latch stud 400 may include an enlarged side latch member 420. In one embodiment, latch member 420 may have a non-circular oblong shape and dimensions similar to the operating button 407. This aspect and the configuration of the cam surface features of the shaft 404 further described herein allows ambidextrous mounting of the latch stud 300 to the firearm mid-stock 27 to operate side latch style magazines having the side retention feature placement on either the right or left side of the magazine. Latch member 420 is slideably mounted and movable at least partially through one of the complementary configured elongated openings 410 formed in the right sidewall 411 of the mid-stock 27. Similarly, operating button 407 is also slideably mounted and movable at least partially through the remaining complementary configured elongated opening 410 formed in the left lateral sidewall 411 of the mid-stock 27. Openings 410 thus each open laterally outwards and penetrate the mid-stock sidewalls. This allows the latch stud 400 to selectively slide between the right and left lateral sides of the firearm when actuated. It bears noting that in one embodiment, each of the magazine well inserts 100, 200, 300 further include a pair of laterally open apertures 160 arranged to receive the operating button 407 and opposite latch member 420 with side latch protrusion 403 at least partially therein. The mid-stock extension sleeve 27-1 in turn has a side or lateral mounting opening 410 formed in each opposing right and left sidewall 411 of the mid-stock 27 (see, e.g. FIG. 36). Mounting openings 410 are complementary configured to operating button 407 and latch member 420, which are positioned in the openings 410 for depressing and operating the latch stud 400 (see also FIGS. 5 and 41).

The pair of lateral apertures 160 in each magazine well insert are longitudinally elongated and also include a portion which is complementary configured to the operating button 407 and latch member 420 (see, e.g. FIGS. 6B and 7-14). In one embodiment, aperture 160 may have an arcuately curved rear end portion and an open front end which penetrates the vertical peripheral edge of the front wall 101 of the magazine well inserts at the corner region. One aperture 160 may be formed in each of the right and left lateral sidewalls 103, 104 of all of the magazine well inserts 100, 200, and 300 proximate to front wall 101 (see, e.g. FIGS. 7-14 which is illustrative of all three magazine well inserts). The apertures 160 may extend completely through and penetrate the lateral sidewalls 103, 104 of the inserts to provide access to the internal central cavity 105 of the magazine well inserts. In one embodiment, at least the right aperture 160 of the magazine well insert 200 (for right side latching magazines) associated with side latch protrusion 403 of the universal latch stud 400 when positioned on the right completely penetrates the sidewall. Both the right and left lateral apertures 160 of the magazine well inserts 100, 200, and 300 may completely penetrate their respective sidewalls of the inserts and communicate with central cavity 105 of the inserts.

In addition, it bears noting that interaction between the non-circular oblong shape of the lateral openings 410 and complementary configured operating button 407 and latch member 420 advantageously prevents the cylindrical latch stud 400 from rotating in the mid-stock 27. This maintains the proper rotational orientation of the angled latch stud cam surface 406 with respect to the camming protrusions 125 formed on the front latch levers 120, 120A, as further described herein. In alternative embodiments having a circular shaped operating button 82 and side latch member 88, other means for ensuring proper rotational orientation of the latch stud 53 should preferably be provided.

With continuing reference to FIGS. 30-35, a side latch protrusion 403 extends transversely inwards from the side latch member 420. Latch protrusion 403 is positioned to engage the side retention feature 251 (e.g. opening or window) in side latch style magazine 250. The latch protrusion 403 further is inserted through the side window 227 formed in right lateral sidewall 103 of the magazine well insert 200 to access the side retention feature 251 of magazine 250 positioned inside the magazine well insert. The latch protrusion 403 may have any suitable configuration and dimensions selected to be compatible with and engage the retention feature. In one embodiment, the latch protrusion 403 may have an arcuately curved front end portion and an opposing straight rear end portion in side view looking outwards from the longitudinal axis LA.

The latch stud 400 is slideably movable left and right in the lateral or transverse direction between a locked position (e.g. left) in which a magazine is retained in the magazine well insert in use in the firearm, and an unlocked position (e.g. right) disengaging and releasing the magazine, respectively. Moving the latch stud laterally operates to selectively move the side latch member 420 between an inward latched position in which latch protrusion 403 protrudes into the magazine well insert 200 and engages a side latching magazine 250, and an unlatched position in which the latch protrusion 403 is retracted from the magazine well insert 200 to disengage and release the side latching magazine.

When one of the front latching magazines 150 or 350 is positioned in magazine well insert 100 or 300 when mounted in the mid-stock 27 of firearm 20, moving the latch stud 400 laterally operates to selectively pivot the front latch levers 120 or 120A between an rearward latched and a forward unlatched position. In the latched position, depending on whether magazine well insert 100 or 300 is in use, the latch levers 120 or 120A will lockingly engage a respective front latch style of magazine 150 or 350 when inserted in the magazine well insert. Conversely in the unlatched position, one of the latch levers 120 or 120A will disengage its respective front latch style of magazine when inserted in the magazine well insert. Accordingly, the latching stud 300 is configured to operate and latch or unlatch whichever type of front or side latching magazine happens to be inserted in the firearm so long as the appropriate magazine well insert 100, 200, or 300 is in place.

Figure 30:
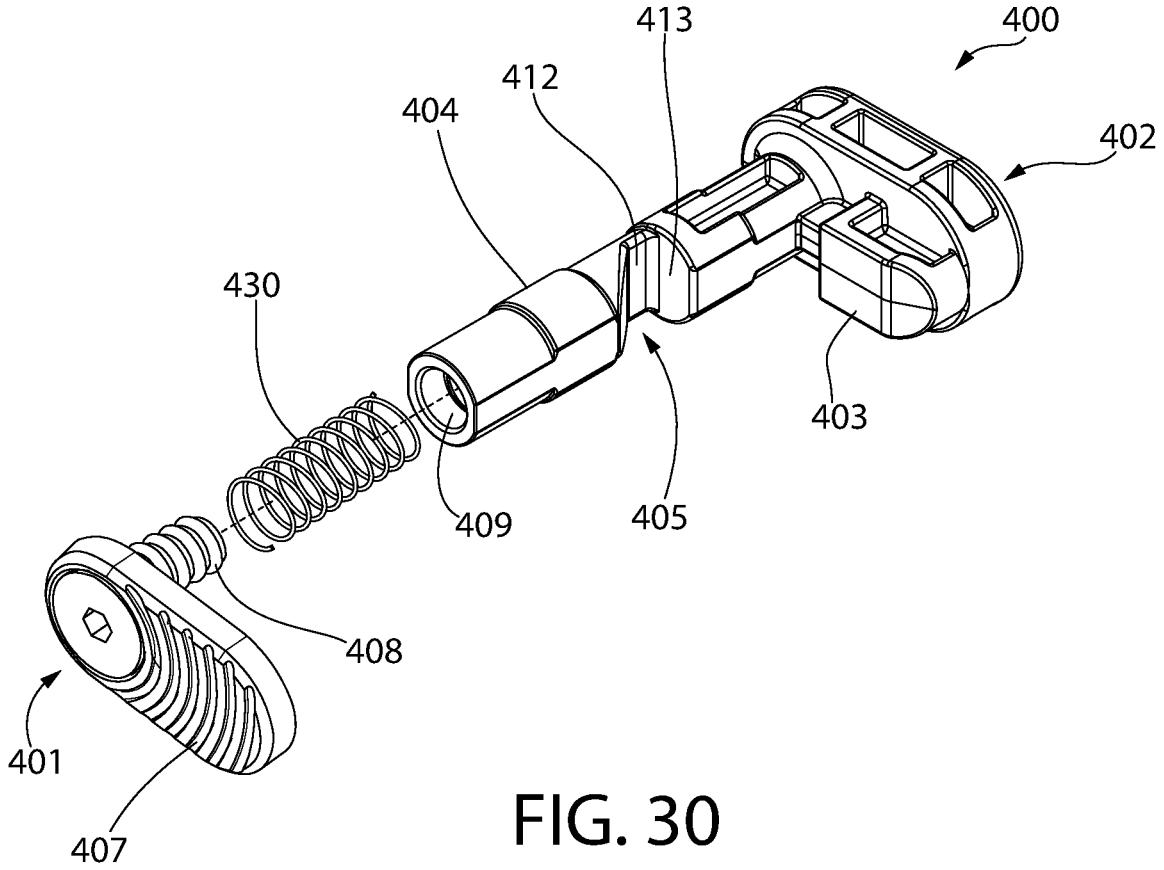
FIG. 30 shows an exploded perspective view of the universal latch stud.

Referring to FIG. 30, an operating spring 430 is mounted on the latch stud 400 and acts to bias the shaft 404 towards the left locked position. Spring 430 may be a helical compression spring in one embodiment which is received around a portion of the latch stud shaft 404 proximate to the operating end 401 of the stud; however, other types of springs may be used. One end of spring 430 acts on the inside of the operating button 407 and an opposite end acts on the left latch stud support block 500 as seen in FIG. 36. This acts to bias the latch stud 400 laterally to the left so that the operating button 407 is forced outward from the left side of the mid-stock 27 when the latch stud is in the mounting position shown (recognizing that the stud is ambidextrous and may be reversed). Concomitantly, spring 430 biases the latching member 420 with side latch protrusion 403 thereon inwards to engage the side catch feature of a side catch magazine when used in the firearm.

Referring to FIGS. 30-35, latch stud 400 further includes an obliquely inclined or angled cam surface 406 which actuates and operates the latch levers 120/120A via sliding the shaft transversely between the locked and unlocked positions. Cam surface 406 is configured and arranged to engage the camming protrusion 125 on the operating portions of the latch levers 120/120A, as described above. In one embodiment, the cam surface 406 may be formed on the latch stud within a concavely shaped and rearwardly open recess 405 formed on the rear side of the latch stud 400 (orientations given with respect to the latch stud 400 mounted in the mid-stock 27). Also within recess 405 is a generally flat and rearward facing bottom seating surface 412 contiguously adjoining cam surface 406 as shown. Seating surface 412 is cut or otherwise formed deepest into the shaft 404 of latch stud 400 and faces rearward. Seating surface 412 is oriented parallel to the axial centerline CL of the latch stud 400 which defines a direction of action. The inclined cam surface 406 extends laterally outwards and forward from the seating surface towards end 401 of the latch stud 400. A flat abutment surface 413 may be provided which is oriented perpendicular to the centerline CL of the latch stud 400 and positioned on an opposite side of recess 405 from cam surface 406. The abutment surface 413 is arranged to engage the side of latch lever 120/120A and functions to resist the biasing force of spring 430, thereby forming a travel limit stop which restricts the left-most lateral position of the latch stud 400 when in the locked position.

Figure 31:
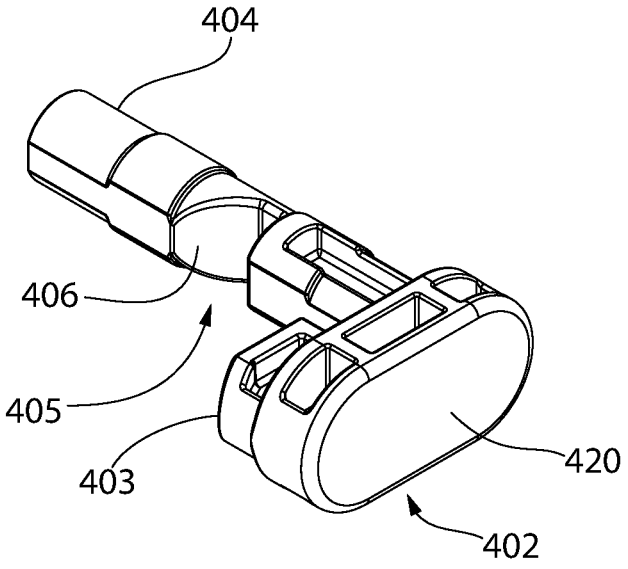
FIG. 31 is a left perspective view thereof.
Figure 32:
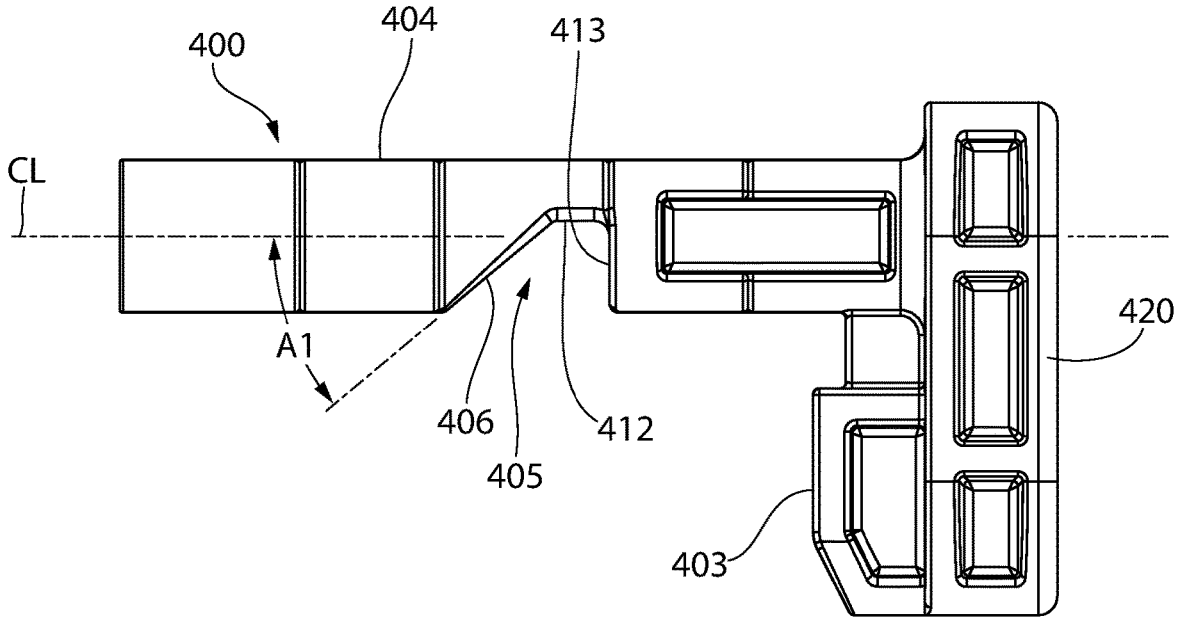
FIG. 32 is a top view thereof.
Figure 33:
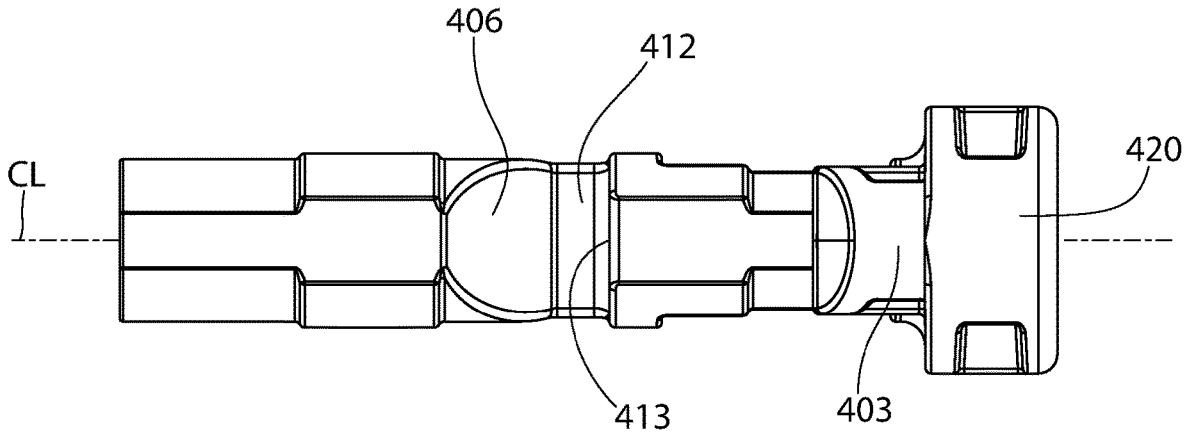
FIG. 33 is a rear view thereof.

The inclined or angled cam surface 406 may be obliquely angled at angle A1 with respect to the centerline CL of the latch stud 400 and may comprise a generally flat surface (best shown in FIG. 31). In other embodiments contemplated, the angled cam surface 406 may alternatively be arcuately and concavely curved inwards in shape instead. Cam surface 403 may terminate at the full-diameter outer circumferential surface of the latch stud 400. The cam surface 406 and seating surface 412 thus forms a reduced diameter portion of the latch stud. In one non-limiting arrangement, the cam surface 406 may be approximately near the center of the camming stud shaft 404 approximately midway between the operating end 401 and latching end 402. This coincides with the centered mounting position of the front latch levers 120/120A on the magazine well inserts 100 and 300 respectively which interact with the cam surface 406.

In operation when the latch stud 400 is in the left locked position, the camming protrusion 125 on latch lever 120/120A are positioned and seated against seating surface 412 which represents a neutral position in which the rear latch protrusion 124 is engaged with a front latching magazine 150 or 350 (depending on which magazine well insert 100 or 300 is mounted in the firearm 20). The seating surface 412 represents the deepest and thinnest portion of the latch stud at the deepest part of the cam surface 406. When the camming stud 53 is in the right unlocked position, the camming protrusion 125 is positioned on the inclined cam surface 406 farther from the centerline CL of the latch stud 400 than when it is resting on the seating surface 412.

Figure 34:
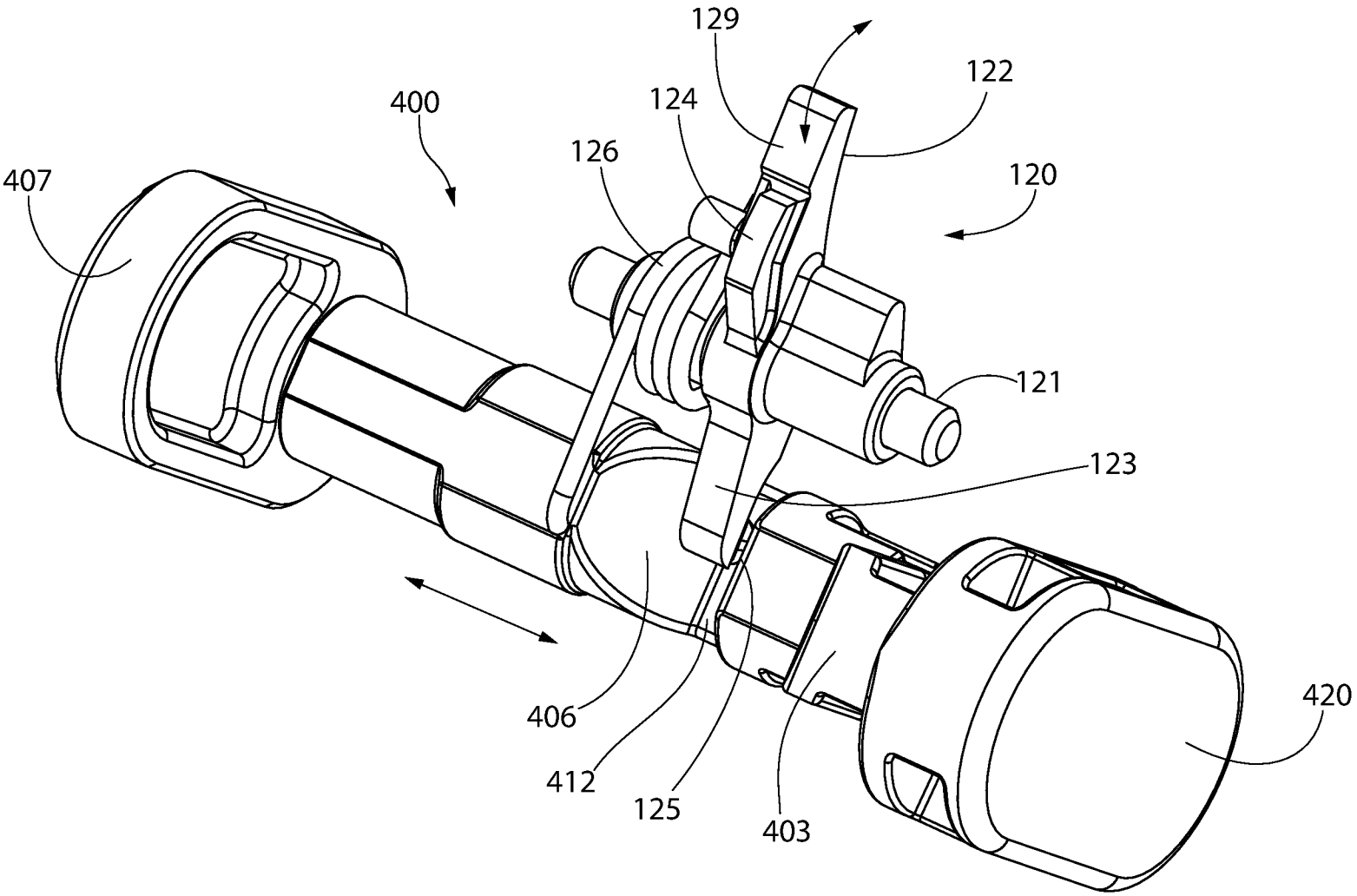
FIG. 34 is a front perspective view showing the latch stud engaged with a first embodiment of a front latching lever of the first magazine well insert.
Figure 35:
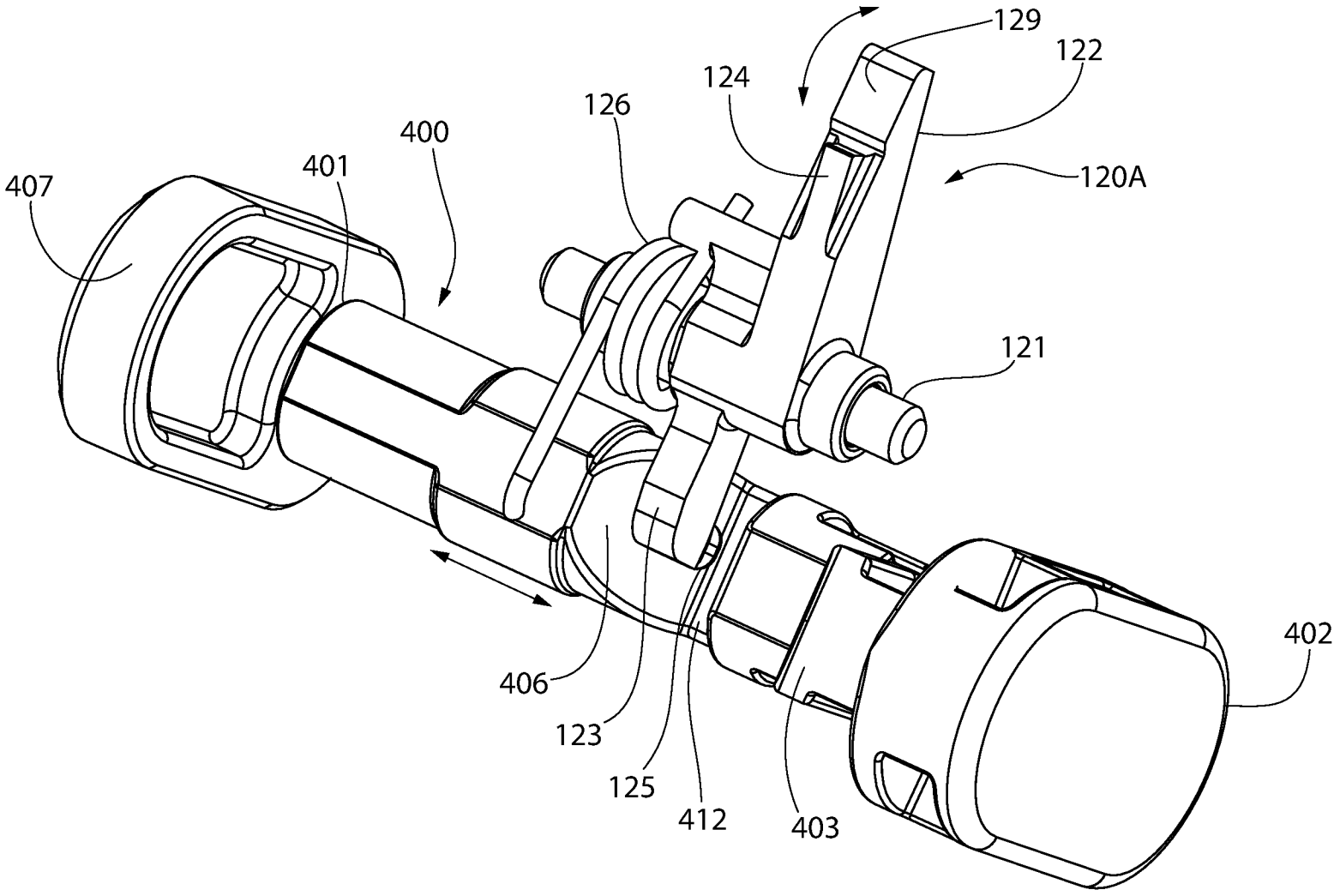
FIG. 35 is a front perspective view showing the latch stud engaged with a second embodiments of a front latching lever of the third magazine well insert.

As the latch stud 400 is moved linearly and transversely to the unlocked position, the camming protrusion 125 slides along and maintains continuous contact with the cam surface 406 (due to the biasing action of latch spring 126 (see, e.g. FIGS. 34 and 35). Camming protrusion 125 slides outwards/forward from the seating surface 412 along cam surface 406. The camming protrusion 125 on latch levers 120/102A may be slightly rounded in some embodiments to provide smooth sliding motion along the inclined cam surface 406. When the camming stud 53 reaches the right-most unlocked position, the camming protrusion 125 has now moved to a position higher on the inclined cam surface 406 and more proximate to the outer circumferential surface of the latch stud shaft 404. In the process, the operating arm 123 of the latch lever 120/120A is displaced and rotated rearward in a vertical plane towards the magazine well insert 100/300. This in turn rotates the latching arm 122 in an opposite direction forward away from and out of the central cavity 105 of the magazine well insert 100/300 to disengage the front latching magazine 150/350. The magazines are thus released from the magazine well insert and removed from the firearm for exchange. Accordingly, the latch stud 400 converts linear motion of the stud in a horizontal plane to rotary motion of the latch lever 120/120A in a vertical plane.

In one non-limiting embodiment which is disclosed herein, latch stud 400 is completely reversible in the mid-stock 27 of the firearm for either right or left-handed operation. The oblong openings in both lateral sides of the mid-stock are the same in configuration making this change in operating position of the latch stud possible.

Methods for latching and unlatching a magazine in a firearm using the latching mechanisms disclosed herein will now be briefly reviewed. In the normal non-actuated position, the latch stud 400 of the latching mechanism defaults to the spring-biased locked position shown in FIGS. 34 and 35. The operating button 407 may be substantially flush with or slightly protruding from the left lateral sidewall 411 of the mid-stock 27 and latching member 420 may be substantially flush with or slightly protruding from the opposite right lateral sidewall 411. Use of the term "substantial" means that the outer surfaces of the operating button 407 and/or latching member 420 may be slightly recessed in or slightly protrude beyond the sidewalls, but for all intents may still be considered flush with the sidewalls.

A first operating scenario will demonstrate mounting a side latching style magazine 250 having a side catch or retention feature 251 such as a retention lip or an opening either of which define a retention surface (see, e.g. FIG. 44). The process begins with providing a side latching magazine 250 and magazine well insert 200 adapted for use with side latching magazines. It is assumed that there is either no magazine well insert initially positioned in the magazine well insert receptacle 60 of the firearm mid-stock 27, or an existing different type insert (e.g. front latching) may already have been emplaced in the firearm 20 and was removed in accordance with the process previously described herein. The side latching magazine well insert 200 is first mounted in the mid-stock 27 in accordance with the process previously described herein. During the process, side latch protrusion 403 which is in the inward latched position on the right side of the firearm 20 is initially displaced slightly outwards in the lateral direction towards the right by the right lateral sidewall 103 of the magazine well insert 200. This temporarily moves the latch protrusion 403 into the unlatched position (and corresponding unlocked position of the latch stud 400). Once the right aperture 160 becomes horizontal aligned with the side latch protrusion 403, the protrusion will be forced back inward through aperture 160 into the central cavity 105 of magazine well insert 200 via the biasing action of spring 430, thereby returning the latch protrusion to the latched position (and corresponding locked position of the latch stud 400).

Magazine 250 is now ready for mounting to the firearm mid-stock 27. The upper end of the magazine 250 is inserted into the central cavity 105 of magazine well insert 200 from below in the usual manner. The top end of the magazine 250 initially contacts the side latch protrusion 403 of the latch stud 400. This contact slightly displaces the latch stud 400 laterally outwards from the magazine well 30 towards the right unlocked position during which time the magazine remains in contact with the latch protrusion 403 as the right side of the magazine slides along the protrusion. When the magazine 31 is inserted upwards sufficiently far into the magazine well insert 200, the latch protrusion 403 will eventually reach and become laterally aligned with the side retention feature 251 (e.g. opening or window) in the magazine. This allows the latch stud 400 to automatically snap back to the left into the locked position under the biasing force of spring 430 as the side latch protrusion 403 is inserted into and lockingly engages the retention feature 251 of the magazine. The side latching magazine 250 is now locked into the firearm and ready for use. The foregoing process is automatic because the user need not depress the operating button 407 of the latch stud 400 in order to insert and lock a magazine into the firearm.

To remove the side latching magazine 250, the user manually pushes or depresses the operating button 407 on the left side of the mid-stock 27 inwards in a lateral (transverse) direction toward the right sidewall 411 with a linear motion. This concomitantly moves the latch stud 400 laterally towards the right sidewall 411 of the mid-stock 27 and laterally displaces the side latch member 420 outwards from the right sidewall. This action in turn withdraws and disengages the side latch protrusion 403 from the side retention feature 251 of the magazine 250, thereby moving the side latch member 420 and latch protrusion 403 to the unlatched position. The magazine is released and drops from the magazine well insert 200. The user preferably continues to depress and hold the operating button 407 inwards until the magazine 200 is completely withdrawn from the magazine well. Thereafter, the user releases the operating button 407 which automatically returns the latch stud 400 to its left locked position under the biasing force of spring 430. The magazine latch mechanism is now ready to receive another side latch magazine.

A second operating scenario will demonstrate use of the magazine latch mechanism 50 with one of the front latch style magazines 150/250 having a front retention feature 153/351, such as a protruding retention lip or an opening as illustrated (see, e.g. FIGS. 43 and 45). The process begins by providing the front latch magazine 150 or 250. With an initially empty magazine well insert receptacle 60 in the firearm, one of the front latching magazine well inserts 100 or 300 is first installed in the firearm in the manner previously described herein. The upper latching arms 122 of the front latch levers 120 or 120A are biased and rotated rearward into the central cavity of the magazine well insert 100 or 300 in their latched positions. The latch stud 400 is unactuated in the left locked position. The upper end of the magazine 150 or 350 is first inserted into the magazine well insert 100 or 300 with the front wall of the magazine eventually reaching and contacting the latching arms 122 of the front latch levers 120 or 120A. The latching arm 122 rotates forward about pivot pin 121 into the latch lever's unlatched position (see, e.g. rotational directional arrows in FIG. 34 or 35 for movement). The latching arm 122 continues to slide downward along the front wall of the magazine 150 or 350 as it rises in the magazine well insert. When the magazine is inserted sufficiently far and fully into the central cavity 105 of the magazine well insert 100 or 300, the latch protrusion 124 on the front latch lever 120 or 120A will reach a position horizontally adjacent to the front retention feature 153 or 351 on the magazine 150 or 350. The latching arm 122 of front latch lever 120 or 120A will rotate rearward under the biasing force of spring 126 positioning the latch protrusion 124 on the lever partially through the magazine retention feature 153/351 opening and beneath the upper retention edge of the opening to engage the front wall of the magazine. The magazine 31 can no longer be vertically withdrawn downward and removed from the magazine well insert 100 or 300 due to the blocking interference between the upper retention edge of the magazine retention feature and the latch protrusion 124, thereby locking the magazine in the firearm.

It bears noting that the foregoing mounting sequence also does not require the user to depress the operating button 407 of the latch stud 400 in order to install and lock the magazine in the firearm. In addition when the latch stud 400 is in the locked position with front latch lever 120/120A engaged with the magazine 150/350, the cam protrusion 125 on the front latch lever is seated on the bottom seating surface 412 of the latch stud when the operating button 407 and latch stud 400 have not been actuated by the user. The lower operating arm 123 of the front latch lever 120/120A is therefore correspondingly pivoted forward.

To remove the front latch magazine 150/350 from the firearm, a user manually pushes or depresses the operating button 407 (see, e.g. directional arrows in FIGS. 34 and 35). This moves the latch stud 400 inwards in a right lateral direction again with a linear motion to its unlocked position similar to that described above in the first operating scenario. The lateral shift of the latch stud 400 engages the angled or inclined cam surface 406 with the cam protrusion 125 of the front latch lever 120/120A. The cam protrusion 125 disengages the seating surface 412 and slides upward along the inclined cam surface 406 moving upwards and outwards from the centerline CL of the latch stud toward its outer surface (see, e.g. FIGS. 34 and 35). This progressively rotates the lower operating arm 123 rearward about pivot pin 121 towards the magazine well 30. The upper latching arm 122 of the front latch lever 120/120A in turn rotates in an opposite forward direction away from the magazine well insert 100/300 and magazine 150/350, thereby moving the front latch lever to its unlatched position. Engagement between the lever latch protrusion 125 and the front retention feature 153/351 of the magazine 150/350 is broken, thereby releasing and dropping the magazine from the firearm. Thereafter, the user releases the operating button 407 which automatically returns the latch stud 400 to its left locked position under the biasing force of spring 430.

It bears noting that the interaction between the camming protrusion 125 on the front latch lever 120 or 120A and cam surface 406 on the latch stud 400 operates to convert the lateral linear motion of the stud into pivotable motion of the front latch levers to disengage the front latch magazine. Simultaneously with pivotable action of the respective front latch lever, the lateral motion of the latch stud 400 laterally and linearly displaces the side latch member 420 to disengage side latch protrusion 403 from the side latch magazine 200 if it were installed in the firearm. Accordingly, the single actuation action of the latch stud 400 will conveniently disengage whichever front or side latch style of magazine happens to be installed in the firearm with its corresponding magazine well insert 100/200/300 without requiring further manipulation of another other component or additional steps by the user.

Any appropriate materials may be used for fabricating the components described herein. The magazine well inserts 100, 200, 300 may preferably be formed of molded polymer in one embodiment. Components mounted to the magazine well inserts such as last round hold open actuator 140, ejector 130, and front latch lever assemblies 120 or 120A may preferably be formed of a suitable metal. Universal latch stud 400 may preferably be made of metal or alternatively polymer.

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. A modular magazine well insert system for a firearm, the system comprising:

a longitudinal axis of the firearm;

a stock defining an open mounting receptacle;

an elongated magazine latch stud transversely disposed in the stock proximate to the receptacle, the latch stud slideably movable in a lateral direction between a locked position and an unlocked position;

a first magazine well insert configured for insertion and detachable mounting in the receptacle, the first magazine well insert comprising a walled body defining a downwardly open central cavity configured for receiving a first magazine therein having a front catch feature, and a pivotable first latch lever movable to selectively retain or release the first magazine when positioned in the central cavity; and a second magazine well insert configured for insertion and detachable mounting in the receptacle, the second magazine well insert comprising a walled body defining a downwardly open central cavity configured for receiving a second magazine therein having a side catch feature;

wherein the first and second magazine well inserts each have a common first mounting interface configured to mate with a corresponding second mounting interface formed in the receptacle of the stock.

2. The system according to claim 1, wherein the latch stud includes a cam surface configured to operably engage the first latch lever when the first magazine well insert is positioned in the receptacle, wherein sliding the latch stud between the locked and unlocked positions correspondingly pivots the first latch lever between a latched position which retains the first magazine in the first magazine well insert and an unlatched position which releases the first magazine from the first magazine well insert.

3. The system according to claim 2, wherein the latch stud further includes a side latch protrusion configured to operably engage the side catch feature of the second magazine when the second magazine well insert is positioned in the receptacle, wherein sliding the latch stud between the locked and unlocked positions correspondingly moves the side latch protrusion between a latched position which retains the second magazine in the second magazine well insert and an unlatched position which releases the second magazine from the second magazine well insert.

4. The system according to claim 3, wherein the second magazine well insert includes a lateral aperture, the side latch protrusion insertable through the lateral aperture to engage the side catch feature of the second magazine when the side latch protrusion is in the latched position.

5. The system according to claim 2, further comprising a third magazine well insert configured for insertion and detachable mounting in the receptacle, the third magazine well insert comprising a walled body defining a downwardly open central cavity configured for receiving a third magazine therein having a front catch feature different than the front catch feature of the first magazine, the third magazine well insert including a pivotable second latch lever movable to selectively retain or release the third magazine when positioned in the central cavity of the third magazine well insert.

6. The system according to claim 5, wherein the cam surface of the latch stud is further configured to operably engage the second latch lever when the third magazine well insert is positioned in the receptacle, wherein sliding the latch stud between the locked and unlocked positions correspondingly pivots the second latch lever between a latched position which retains the third magazine in the third magazine well insert and an unlatched position which releases the third magazine from the third magazine well insert.

7. The system according to claim 1, wherein the latch stud includes an operating button on a first end and a latch member on a second end configured to engage the side catch feature of the second magazine when the second magazine well insert is positioned in the receptacle.

8. The system according to claim 7, wherein the latch member of the latch stud includes an inwardly extending side latch protrusion which engages the side catch feature of the second magazine when the second magazine well insert is positioned in the receptacle.

9. The system according to claim 8, further comprising a spring acting on the latch stud and arranged to bias the side latch protrusion inwards towards the receptacle.

10. The system according to claim 7, further comprising a laterally open aperture formed in each of a pair of opposing lateral sidewalls of the first and second magazine well inserts, the operating button received at least partially in a first one of the apertures and the latch member received at least partially in a second one of the apertures.

11. The system according to claim 1, further comprising a spent cartridge ejector mounted to a rear wall of each of the first and second magazine well inserts.

12. The system according to claim 11, further comprising a vertically elongated last round hold open actuator slideably mounted proximate to a front wall of each of the first and second magazine well inserts, the hold open actuator configured and arranged to engage a follower of the first or second magazine when positioned in the first or second magazine well inserts respectively.

13. The system according to claim 1, wherein the latch stud is slideably supported by a pair of laterally spaced apart support blocks disposed in a longitudinally-extending cavity of the stock forward of the receptacle.

14. The system according to claim 1, wherein the common first mounting interface of the first and second magazine well inserts comprises a pair of peripheral mounting flanges extending protruding laterally outwards from sidewalls of the first and second magazine well inserts.

15. The system according to claim 14, wherein the mounting flanges are arranged to engage corresponding upward facing longitudinal seating surfaces formed in the stock within the receptacle.

16. The system according to claim 15, wherein the first and second magazine well inserts are retained in the stock by a receiver removably mounted to the stock, the mounting flanges being trapped between the longitudinal seating surfaces of the stock and bottom surfaces of the receiver.

17. The system according to claim 16, wherein the mounting flanges each include a castellated configuration defining a plurality of top bearing surfaces on each mounting flange which engage the bottom surfaces of the receiver.

18. The system according to claim 1, wherein the receptacle has a configuration which cannot retain the first or second magazine in the stock without the first or second magazine well inserts.

19. The system according to claim 1, wherein each of the first and second magazines are configured for holding ammunition cartridges of the same size.

20. A modular magazine well insert system for a firearm, the system comprising:

a longitudinal axis of the firearm;

a stock extending along the longitudinal axis and including a right sidewall, a left sidewall, and an upwardly open stock receptacle configured for mounting one of a plurality of interchangeable magazine well inserts therein each configured and operable to retain an ammunition magazine;

each of the plurality of magazine well inserts have a common mounting interface configured to mate with a corresponding upward facing mounting interface formed on the stock within the stock receptacle and a downward facing mounting interface formed on a bottom of a receiver attached to the stock;

an elongated magazine latch stud extending transversely through the right and left sidewalls of the stock proximate to the receptacle, the latch stud defining a centerline transversely oriented to the longitudinal axis, the latch stud slideably movable in a lateral direction between an inward locked position and an outward unlocked position;

a spring biasing the latch stud towards the locked position;

the latch stud including an operating end configured for actuating the latch stud and a latching end configured for engaging a side catch feature of a side latching magazine, and a rearwardly open recess between the ends defining a cam surface obliquely angled to the centerline of the latch stud for operating a latching lever of a magazine well insert configured to engage a front catch feature of a front latching magazine.

21. The system according to claim 20, further comprising:

a first magazine well insert detachably mounted in the stock receptacle, the first magazine well insert comprising a walled body defining a downwardly open central cavity configured for receiving a first magazine therein having a front catch feature, and a pivotable first latch lever positioned to engage the cam surface and movable to selectively retain or release the first magazine when positioned in the central cavity; and a second magazine well insert configured for insertion and detachable mounting in the receptacle when exchanged for the first magazine well insert, the second magazine well insert comprising a walled body defining a downwardly open central cavity configured for receiving a second magazine therein having a side catch feature;

wherein the second magazine well insert includes a lateral aperture arranged to receive an inwardly extending side catch protrusion formed on the latching end of the latch stud which engages the side catch feature of the second magazine for retention in the second magazine well insert.

22. The system according to claim 21, wherein laterally moving the latch stud engages a camming protrusion on the first latch lever with the cam surface and pivots the first latch lever to release the first magazine.

23. The system according to claim 22, wherein laterally moving the latch stud between the locked and unlocked positions concurrently moves the first latch lever between a spring-biased latched position retaining the first magazine and an unlatched position releasing the first magazine from the central cavity of the first magazine well insert.

24. The system according to claim 21, wherein the rearwardly open recess of the latch stud further includes a rear facing flat seating surface oriented parallel to centerline of the latch stud and a laterally facing flat abutment surface opposite the obliquely angled cam surface, the seating surface engaging the seating surface when the first latch lever is in the latched position.

25. The system according to claim 20, wherein the common mounting interface of the magazine well inserts comprises a pair of peripheral mounting flanges protruding laterally outwards from sidewalls of each of the magazine well inserts, the mounting flanges being trapped between the upward facing mounting interface of the stock which comprises a pair of spaced apart surfaces and the downward facing mounting interface of the receiver which comprises a spaced apart surfaces.

26. The system according to claim 20, wherein each of the magazine well inserts further comprises:

a spent cartridge ejector mounted to a rear wall of each of the magazine well inserts; and a vertically elongated last round hold open member slideably mounted proximate to a front wall of each of the magazine well inserts for vertical upward and downward movement, the hold open actuator configured and arranged to engage a follower of the magazine when positioned in the first or second magazine well inserts respectively;

wherein the last round hold open member is slideably received through a hole in the common mounting interface of the magazine well inserts.

27. The system according to claim 20, wherein the stock receptacle has a configuration which cannot retain the magazine in the stock without one of the magazine well inserts mounted in the stock.

28. The system according to claim 20, wherein each of the magazine well inserts includes a laterally open aperture formed in each of a pair of opposing lateral sidewalls of the first and second magazine well inserts, the operating end of the latch stud received at least partially in a first one of the apertures and the latching end of the latch stud received at least partially in a second one of the apertures.

29. A method for retaining magazines in a firearm, the method comprising:

providing a firearm stock having a laterally movable latch stud slideably mounted therein;

inserting a first magazine well insert into an open receptacle of the firearm stock adjacent to the latch stud;

engaging a pair of peripheral mounting flanges on the first magazine well insert with a corresponding pair of seating surfaces disposed in the receptacle of the firearm stock;

lowering a receiver onto the firearm stock;

engaging a pair of locking surfaces on the receiver with the pair of mounting flanges on the first magazine well insert;

drawing the receiver downwards in the firearm stock via tightening at least one mounting fastener;

compressing the mounting flange of the first magazine well insert between the locking surfaces and seating surfaces; and inserting a first magazine into the first magazine well insert.

* * * * *